US008720031B2

(12) United States Patent
Sauer

(10) Patent No.: US 8,720,031 B2
(45) Date of Patent: May 13, 2014

(54) ASSEMBLY SYSTEM FOR CONNECTING FURNITURE ELEMENTS

(76) Inventor: Steen Sauer, Copenhagen (DK)

( * ) Notice: Subject to any disclaimer, the term of this patent is extended or adjusted under 35 U.S.C. 154(b) by 37 days.

(21) Appl. No.: 13/375,405

(22) PCT Filed: Apr. 8, 2010

(86) PCT No.: PCT/EP2010/054668

§ 371 (c)(1),
(2), (4) Date: Nov. 30, 2011

(87) PCT Pub. No.: WO2010/115967

PCT Pub. Date: Oct. 14, 2010

(65) Prior Publication Data

US 2012/0102710 A1 May 3, 2012

(30) Foreign Application Priority Data

Apr. 8, 2009 (EP) ..... 09005163

(51) Int. Cl.

| | |
|---|---|
| ***B23P 11/00*** | (2006.01) |
| ***E04C 2/38*** | (2006.01) |
| ***E04F 19/00*** | (2006.01) |
| ***F16B 21/02*** | (2006.01) |
| ***A47G 29/02*** | (2006.01) |

(52) U.S. Cl.

USPC ..... 29/428; 52/656.9; 52/36.4; 403/348; 403/22; 411/85; 248/243

(58) Field of Classification Search

USPC ..... 29/428, 434, 525.01, 525.03, 525.08; 312/280, 293.1–293.3, 351, 408; 403/348, 247, 252, 253, 254, 256, 257, 403/261

See application file for complete search history.

(56) References Cited

U.S. PATENT DOCUMENTS 576,939 A 2/1897 Baines
2,285,632 A * 6/1942 Urbain ..... 211/60.1

(Continued)

FOREIGN PATENT DOCUMENTS

DE 4137079 9/1992
DE 4237970 8/1993

(Continued)

OTHER PUBLICATIONS

International Search Report on related PCT application (PCT/EP2010/054668); International Searching Authority (EPO) dated Jul. 19, 2010.

(Continued)

*Primary Examiner* — David Bryant
*Assistant Examiner* — Jun Yoo
(74) *Attorney, Agent, or Firm* — Klein, O'Neill & Singh, LLP

(57) ABSTRACT

The present invention relates to a system for assembling a piece of furniture. The system comprises an elongated track element including a recessed bottom wall having a plurality of equidistantly spaced apart indentations and opposite front flanges defining there between a channel. The system further includes a fitting element having a main portion defining a front surface and opposite rear surface, an arresting pin extending from the rear surface, and a transversal bar extending parallel with the front and rear surfaces. The fitting element is arrested relative to the elongated track element in a three-step operation. The first step involving positioning the fitting element in front of the channel and introducing the transversal bar into the channel. The second step involves rotating the fitting element while maintaining the transversal bar within the channel. The third step involves receiving the arresting pin within a single indentation of the bottom wall.

14 Claims, 28 Drawing Sheets

(56) References Cited

U.S. PATENT DOCUMENTS

| | | | | |
|---|---|---|---|---|
| 2,784,812 | A | 3/1957 | Kindorf | |
| 2,931,612 | A * | 4/1960 | Graber | 248/214 |
| 3,795,453 | A * | 3/1974 | Condevaux | 403/3 |
| 4,161,303 | A * | 7/1979 | Bachand | 248/246 |
| 5,154,385 | A | 10/1992 | Lindberg et al. | |
| 5,155,960 | A * | 10/1992 | Shaanan | 52/584.1 |
| 5,277,512 | A | 1/1994 | Dwillies | |
| 7,162,837 | B1 | 1/2007 | Roth | |
| 7,401,995 | B2 | 7/2008 | Senakiewich, II | |
| 7,517,117 | B2 | 4/2009 | Moreland et al. | |
| 7,677,830 | B1 | 3/2010 | Brown | |
| 7,814,710 | B2 | 10/2010 | Foglia | |
| 7,934,331 | B2 | 5/2011 | Zlotocha | |
| 2004/0084589 | A1 | 5/2004 | Berardi | |
| 2007/0137134 | A1 | 6/2007 | Plagemann et al. | |

FOREIGN PATENT DOCUMENTS

| | | | |
|---|---|---|---|
| DE | 4436769 | | 4/1996 |
| DE | 10240793 | | 3/2004 |
| FR | 1528110 | | 6/1968 |
| FR | 2097461 | | 3/1972 |
| JP | 01-141604 | | 6/1989 |
| WO | WO94/23613 | | 10/1994 |
| WO | WO 9423613 | A1 * | 10/1994 |
| WO | WO2009/044235 | | 4/2009 |

OTHER PUBLICATIONS

Non-Final Office Action on co-pending U.S. Appl. No. 12/680,894 dated Jan. 26, 2012.

Non-Final Office Action on co-pending U.S. Appl. No. 13/559,385 dated Oct. 25, 2012.

Final Office Action on co-pending U.S. Appl. No. 13/559,385 dated May 22, 2013.

International Search Report on related PCT application (PCT/IB2007/054163); International Searching Authority (EPO) dated Feb. 12, 2009.

Final Office Action on co-pending U.S. Appl. No. 13/559,385 dated Dec. 19, 2013.

* cited by examiner

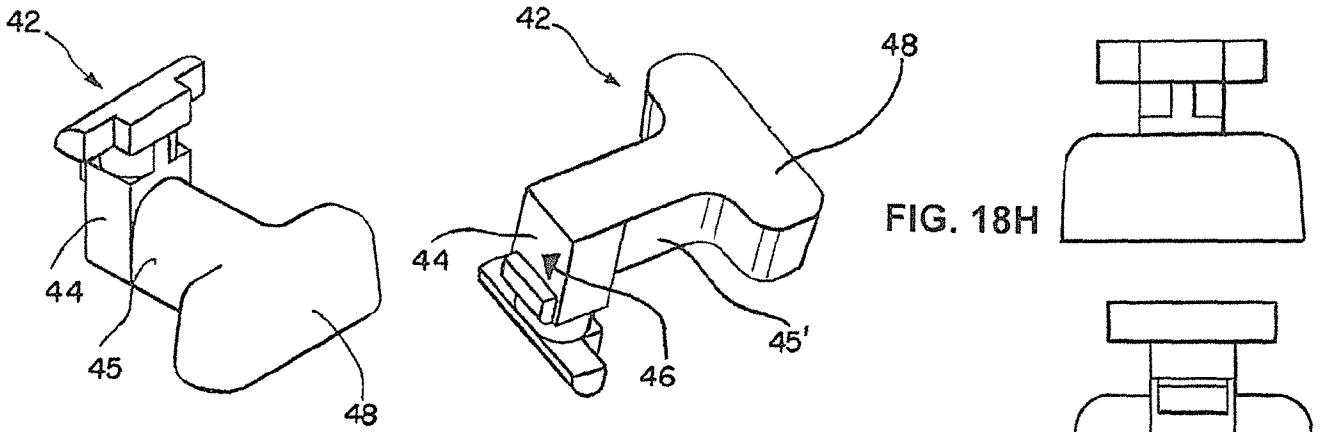
FIG. 18A
FIG. 18B
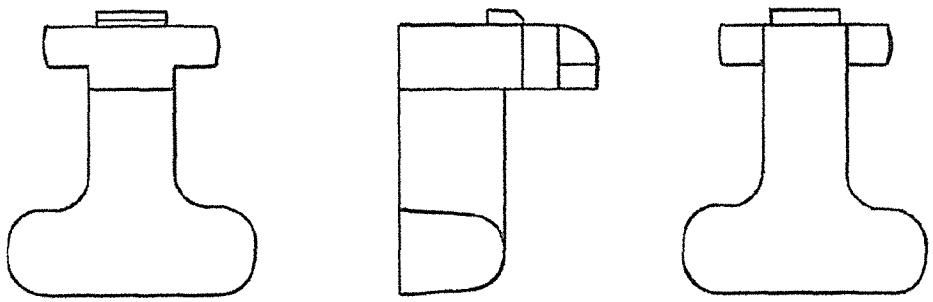
FIG.18C
FIG. 18D
FIG. 18E
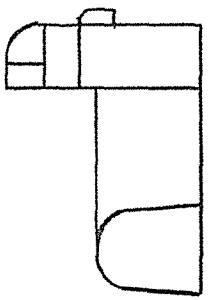
FIG. 18F
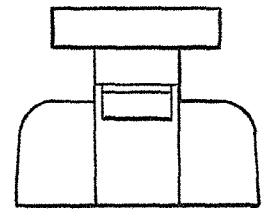
FIG. 18G
FIG. 18H

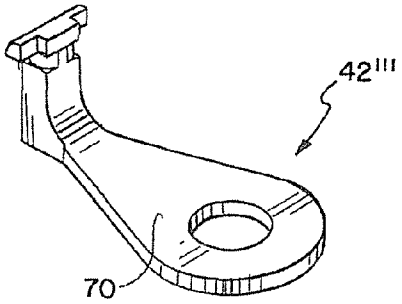
FIG. 22A
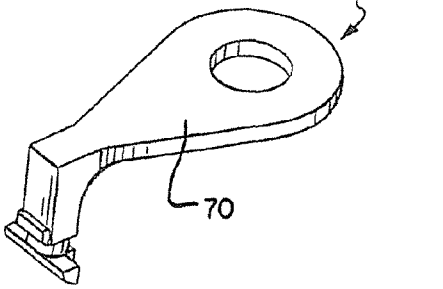
FIG. 22B
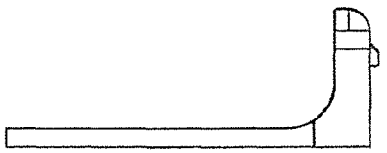
FIG.22C
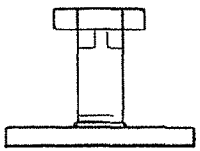
FIG. 22D
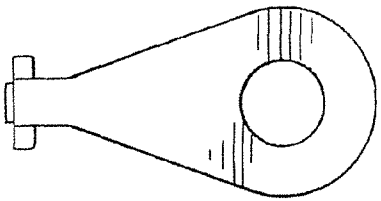
FIG. 22E
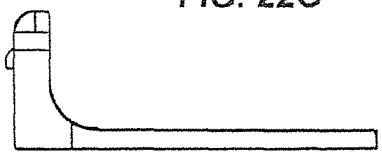
FIG. 22F
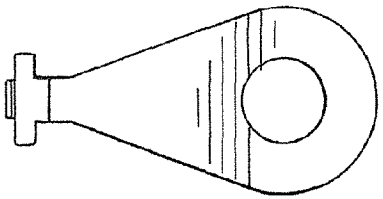
FIG. 22G
FIG. 22H

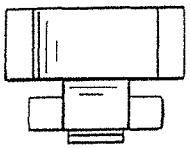
FIG. 23G
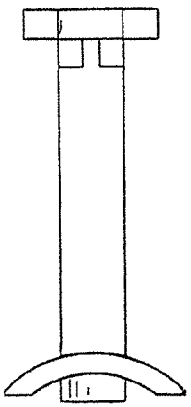
FIG. 23D
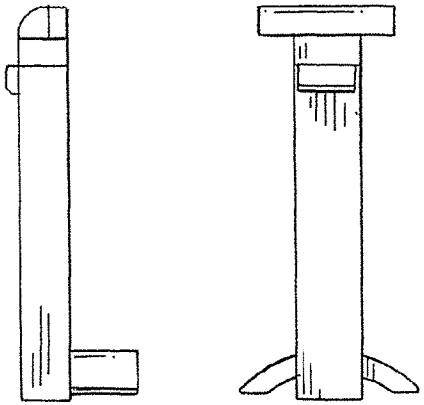
FIG. 23E
FIG. 23F
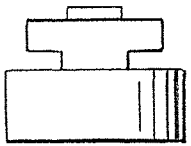
FIG. 23H
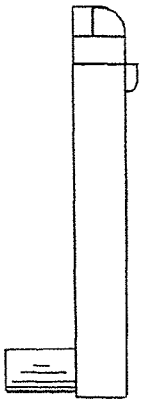
FIG. 23C
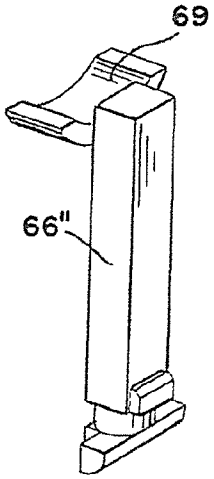
FIG. 23B
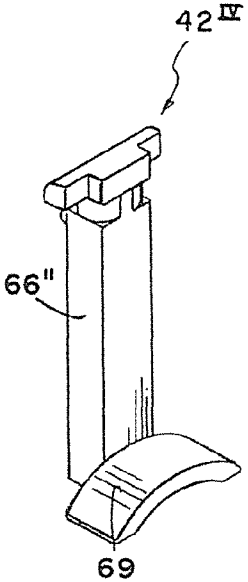
FIG. 23A

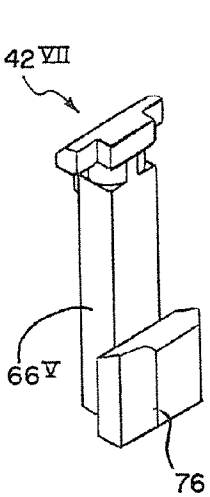
FIG. 26A
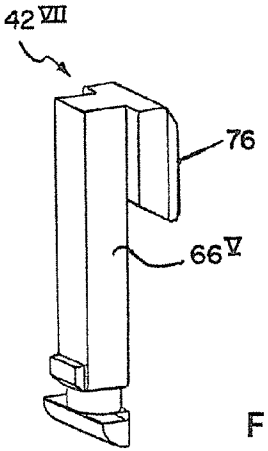
FIG. 26G
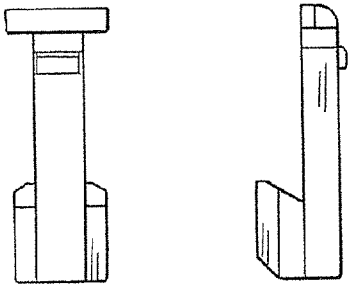
FIG. 26C
FIG. 26D
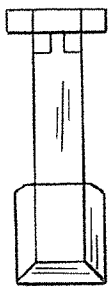
FIG. 26E
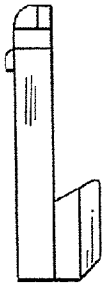
FIG. 26F
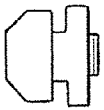
FIG. 26H

ASSEMBLY SYSTEM FOR CONNECTING FURNITURE ELEMENTS

CROSS-REFERENCE TO RELATED APPLICATION

This application is a national phase filing, under 35 U.S.C. §371(c), of International Application No. PCT/EP2010/054668, filed Apr. 8, 2010, the disclosure of which is incorporated herein by reference in its entirety.

FEDERALLY SPONSORED RESEARCH OR DEVELOPMENT

Not Applicable

TECHNICAL FIELD

The present invention relates to an assembly system for furniture, e.g. for connecting elements of a piece of furniture such as cupboard elements and the like.

BACKGROUND OF THE INVENTION

Furniture like cupboards, bookshelves, loudspeakers and the like often comprise plate shaped wall sections, top elements and bottom elements, which are connected along the edges and thereby form spatial shapes.

Since assembling of furniture requires different forms of tool and in some cases machinery, furniture is traditionally assembled at the factory where produced and subsequently delivered in an assembled state. Transportation, handling and storages of such spatially shaped furniture require a great deal of space compared to non-assembled furniture elements, not least for furniture shops and end-users.

Therefore, attempts have been made to deliver non-assembled furniture elements which have to be assembled at the place of use, When the end-user receives the furniture, it is typically packed with a set of assembly elements which often comprises a large amount of screws, nails and similar assembly features. First, the user has to get an overview of the large amount of pieces received. Subsequently, each piece has to be fastened correctly often by use of different tools, It often happens that pieces are mixed up so that assembling of the furniture elements has to be redone, or alternatively that the user has to live with a defective, and possibly unstable and lopsided furniture, An example is described in applicant's international patent application, application No. PCT/IB2007/054163.

SUMMARY OF THE INVENTION

It is an object of the present invention to provide an improved assembly system for connecting furniture elements.

In a first aspect, the invention provides a system for assembling a piece of furniture, the piece of furniture comprising a first plane wall element and a second element, the system comprising:

an elongated track element defining a longitudinal direction, the elongated track element including a recessed bottom wall and opposite front flanges defining there between a channel of a specific width, the recessed bottom wall being spaced at a specific distance behind said opposite front flanges and having a plurality of equidistantly spaced apart indentations or apertures, the elongated track element being attachable to or attached to, preferably being countersunk in the first plane wall element of the piece of furniture, and a fitting element having a main portion defining opposite parallel side surfaces spaced apart a distance equal to or slightly smaller than the specific width and defining a front surface and an opposite rear surface, and the fitting element having an arresting pin extending outwardly from the rear surface of the main portion of the fitting element, further having a transversal bar and a length exceeding the specific width and having a maximum thickness smaller than the specific width, the transversal bar extending parallel with the front and rear surfaces of the main portion of the fitting element, the fitting element being mounted in and arrested relative to the elongated track element in a three-step operation, a first step involving positioning the fitting element having the fitting element positioned in front of the channel and having the transversal bar orientated parallel with the longitudinal direction and having the front and rear surfaces of the main portion of the fitting element extending parallel with the opposite front flanges of the elongated track element and introducing the transversal bar into the channel of the elongated track element, a second step involving rotating the fitting element while maintaining the transversal bar within the channel of the elongated track element so as to position the transversal bar perpendicular to the longitudinal direction of the elongated track element and positioning the rear surface of the main portion of the fitting element juxtaposed the bottom wall of the elongated track element for allowing the fitting element to be shifted along the longitudinal direction relative to the elongated track element, and a third step involving receiving the arresting pin within a single indentation or aperture of the bottom wall of the elongated track element so as to arrest the fitting element relative to the elongated track element.

The system offers a simple way of assembling the furniture, merely by reorientation of the fitting element relative to the elongated track element, whereby the use of tools can be avoided, The elongated track element may be attached to the first furniture element at the factory where the furniture elements are produced. A plurality of elongated track elements may be attached to each of the first furniture elements, e.g. by providing a set of elongated track elements in parallel at a surface of the first furniture element. The elongated track element may be countersunk in a surface of the first furniture element. To provide a plane surface, an upper surface of the elongated track element may form part of the furniture surface whereby the channel may extend in the first furniture element below the surface of the first furniture element. To countersink the elongated track element in the surface of the first furniture element, the first furniture element may be provided with an elongated groove with a cross sectional shape which matches the cross sectional shape of the elongated track element so that an inner surface of the groove is in contact with an outer surface of the elongated track element when the elongated track element is located in the groove.

The elongated track element can be attached adhesively to the first furniture element, or the elongated track element may be interlocked in a groove in the surface by providing a cross sectional shape of the elongated track element which cooperates with a cross sectional shape of the groove, e.g. to form a dovetail joint, or the elongated track element may be attached by nails, screws, rivets, etc. Alternatively or additionally, the outer surface of the elongated track element may have a frictional coefficient, which reduces or prevents sliding of the elongated track element in the groove of the first furniture element. In one embodiment, protrusions may be provided at the outer surface of the elongated track element to engage the inner surface of the groove. The elongated track element may be formed of metal, e.g. aluminium, of plastic or of other materials, e.g. by an extrusion process.

The elongated track element may comprise a flange portion defining an opening Into the channel and which allows passage of the first locking portion Into the channel in the open mutual orientation and which prevents movement of the first locking portion out of the channel in the closed mutual orientation.

To enable assembling of several furniture elements, the fitting element may further comprise a second locking portion adapted to retain a second furniture element.

In the open mutual orientation, the first locking portion is allowed passage into and out of the channel, e.g. by turning the fitting element 90 degrees relative to the direction of use and then inserting the first locking portion into the channel. In the closed mutual orientation, the fitting element may be attached to the elongated track element, e.g. by turning the fitting element 90 degrees whereby the first locking portion may be locked in the channel by the flange portion. In the closed mutual orientation, the first locking portion is moveable in the axial direction within the channel. In the fixed mutual orientation, the first locking portion is locked immovably relative to the elongated track element.

The fitting element may in the fixed mutual orientation form an essentially plane surface portion which is in level with the upper surface of the elongated track element. The first locking portion may be provided as a T-shaped portion with a transverse portion extending perpendicularly to a main portion. The main portion may be shaped so that it extends in the axial direction when the fitting element is in the fixed mutual orientation, The second locking portion may form a protrusion extending from the plane surface portion of the fitting element, e.g. extending perpendicular to the plane surface portion.

The first furniture element may e.g. be a sidewall element or a back wall element of a cupboard or the like, whereas the second furniture element may be a shelf element, a top element, a bottom element, a door element, etc. Thus, the assembly system comprising the elongated track element and the fitting element may be used for joining a cupboard and the like. The assembly system may comprise different types of fitting elements for the same type of elongated track element. As an example, one fitting element may be suitable for a shelf element, whereas another type of fitting element may be suitable for a door element, both types of fitting elements being suitable for the same elongated track element, e.g. an elongated track element which may be attached to a first furniture element in the form of a sidewall element.

When the sidewall elements with the countersunk elongated track elements have been produced at a factory, they could be packed together with a top element and a bottom element and possibly a number of shelf elements. The top element and the bottom element may be formed with depressions or holes for receiving the second locking portion of the fitting element. In a similar manner, the shelf elements could be provided with depressions or holes. A number of fitting elements may be located in the package and the package can be shipped to a buyer. The fitting elements may e.g. be completely identical elements, which are all provided with a first locking portion, which can enter the channel in the elongated track element and be fixated therein. They may further comprise a second locking portion, which can engage a depression or hole in the top and bottom elements or in the shelf elements. The fitting elements may also have different second locking portions. One group of the fitting elements may have a second locking portion which is adapted to engage the depressions or holes in the top and bottom elements, This second locking portion may in some embodiments form an upwardly extending protrusion with a conically shaped outer surface which can enter Into the depressions or holes and which thereby pulls the top or bottom element towards the sidewall element. Another group of the fitting elements may have a second locking portion which can be attached e.g. to a hinge for supporting a door, or the second locking portion may simply serve to be attached to any kind of elements, e.g. by providing a body In which a screw or nail may be fastened.

When the package is received, the user may attach the fitting elements at various places along the elongated track elements by inserting the first locking portion in the channel and by reorienting the fitting element until it is locked in a fixed position relative to the elongated track element. Subsequently, the user may connect the top and bottom elements and optionally the shelf elements without using any tools. If all the fitting elements are identical, almost nothing can go wrong, and if the fitting elements are different, it is not very critical if the user locates them wrongly in the first attempt. The fitting elements will just have to be reoriented in the opposite sequence until the element can be removed from the elongated track element to be repositioned at a new location.

In order to prevent movement of the fitting element in the axial direction when the fitting element and the elongated track element define the fixed mutual orientation, the fitting element and elongated track element may comprise locking features adapted to cooperate.

The invention may provide a flexible assembly system according to which the locking features may provide a plurality of locking positions along the axial direction of the elongated track element. At these locking positions, movement of the fitting element may be prevented and the fitting element may be positioned optionally at one of the locking positions. Providing a plurality of locking positions along the elongated track element may furthermore allow for the use of a plurality of fitting elements in combination with each elongated track element, whereby a first furniture element may be connected to a plurality of second furniture elements. As an example, a first furniture element in the form of a sidewall element or a back wall element may be connected to a plurality of second furniture elements in the form of shelf elements and may further be connected to a top element and to a bottom element, each element being connected via a fitting element at a locking portion along the axial direction, In order to fixate the fitting element in the elongated track element, the locking features of the fitting element may comprise protrusions adapted to engage corresponding cavities in the channel.

Alternatively or additionally, the locking features may comprise an indented surface of one of the fitting element and the elongated track element arranged to engage a projection or indentation in the other one of the fitting element and elongated track element. The projection or indentation may in some embodiments form part of an indented surface of the other part, In some embodiments, the channel may form end portions on opposite side of an intermediate portion in a cross section perpendicular to the axial direction. The end portions may extend towards an opening into the channel, whereby the end portions may define the flange portion.

The elongated track element may define a channel which is open at both ends. These open ends may be dosed using end stops. The fitting element may form these end stops.

In a simple embodiment, the channel may form a quadrangular shape in a cross section perpendicular to the axial direction. The channel may thus comprise a front wall, a rear wall and two sidewalls. The opening may be formed in the front wall. In this embodiment, the front wall and rear wall may be essentially parallel, and the sidewalls may be essentially parallel. Furthermore, the front and rear walls may be perpendicular to the sidewalls.

The cavities, which may be part of the locking features, may be formed in the rear wall of the channel. Alternatively or additionally, the cavities may be formed in the sidewalls or the front wall. The locking features of the fitting element may be positioned in order to fit into these cavities. If the cavities are formed in the rear wall of the channel, the protrusions of the fitting element may be formed at the backside of the main portion.

In some embodiments, the second locking portion may be formed to engage a depression or a hole of the second furniture element, whereby the second locking portion may be hidden when the first and second furniture elements are connected.

The fitting element may be shaped to reduce the distance between the first and second furniture elements when the second locking portion engages the depression or hole of the second furniture element. As an example, the second locking portion may comprise a protrusion having a conically shaped upper part, allowing the fitting element to attract the second furniture element when this element is attached to the second locking portion.

In some embodiments, the fitting element may be used in connection with hinges and the like. As an example, the second locking portion may be connected to a hinge in order to support a door element. One part of the hinge may be connected to cavities provided at the front side of the second locking portion, while the other part of the hinge may be connected to a door element for a piece of furniture, e.g. for a cupboard.

In a second aspect, the invention provides a piece of furniture being assembled by the use of the system according to any of the claims 1-6 and/or the fitting element according to claim 7 and/or the elongated track element according to claim 8.

In a third aspect, the invention provides a method of assembling the system according to claim 1 by performing the three-step operation of claim 1 in the sequence step 1, step 2, step 3.

In a fourth aspect, the invention provides a method of disassembling the system according to claim 1 by performing the three-step operation of claim 1 in the sequence step 3, step 2, step 1.

BRIEF DESCRIPTION OF THE DRAWINGS

Embodiments of the invention will now be further described with reference to the drawings, in which.

DETAILED DESCRIPTION OF THE DRAWINGS

Figure 1:
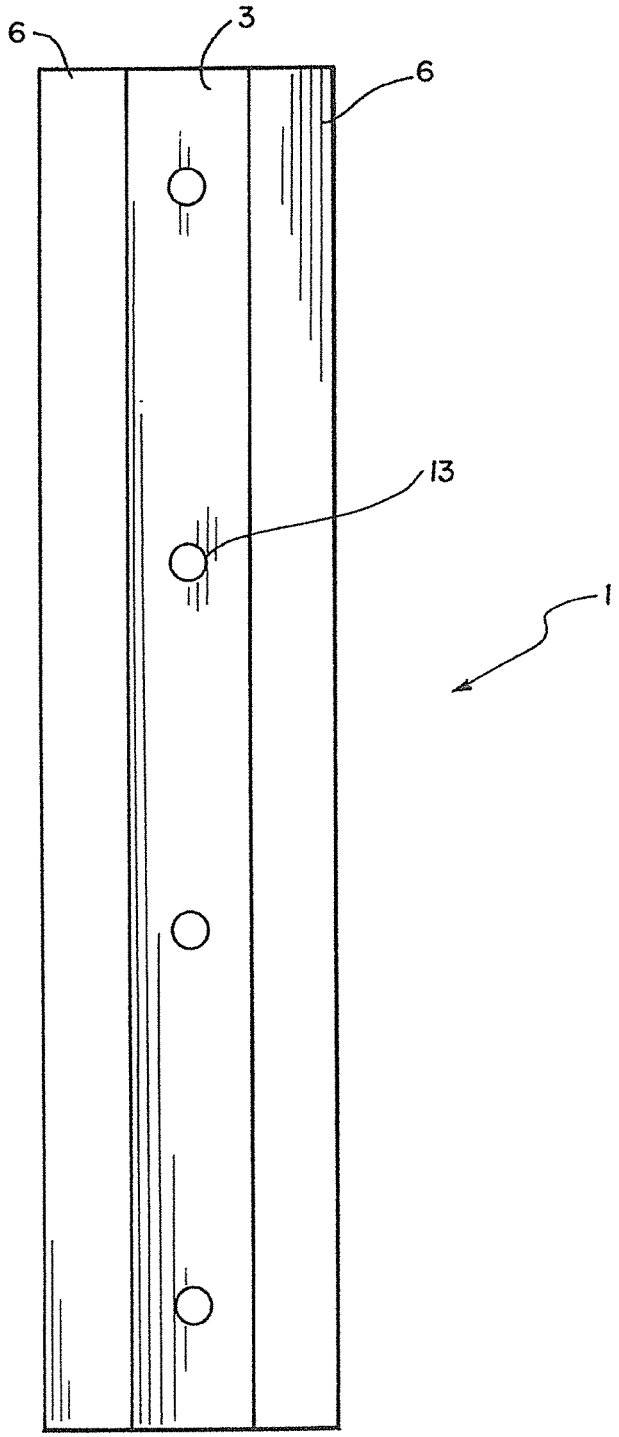
FIGS. 1-1*a* show a first embodiment of an elongated track element.

FIGS. 1. and 2 show an example of an elongated track element 1 (FIG. 1) and an example of a fitting element 2 (FIG.

2) for connecting a first and a second furniture element. The elongated track element 1 is attachable to the first furniture element and defines a channel 3 extending in the axial direction. The fitting element 2 has a first locking portion 4 and a second locking portion 5. The channel 3 comprises a flange portion 6 allowing passage of the first locking portion 4 into and out of the channel 3. Furthermore, the configuration of the flange portion 6 and the locking portion 4 prevents movement of the first locking portion 4 out of the channel 3 in a closed mutual orientation, in which orientation the first locking portion 4 is movable in the axial direction within the channel 3.

The first furniture element may e.g. be a sidewall element or a back wall element of a cupboard, whereas the second furniture element may be a shelf element, a top element, a bottom element or a door element so that the assembly system comprising the elongated track element 1 and the fitting element 2 may be used for joining cupboard elements.

Figure 1A:
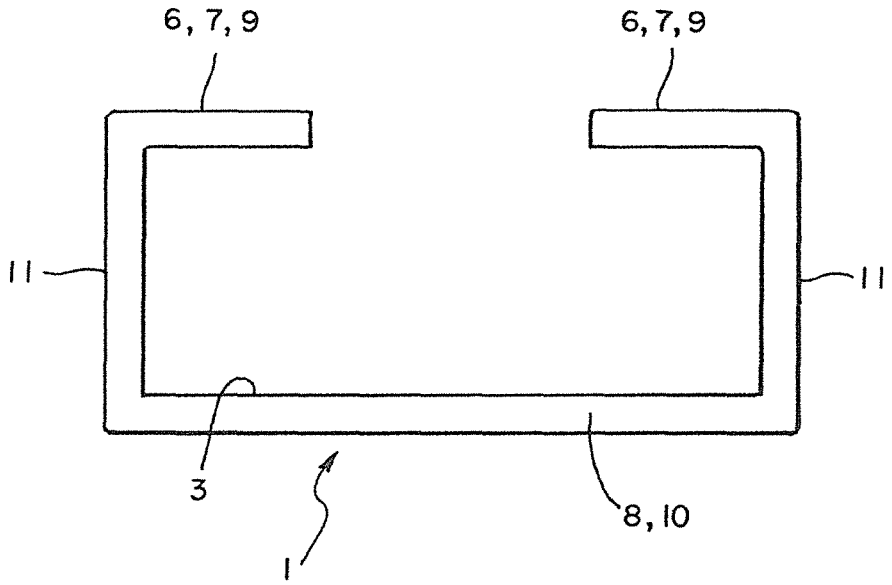

In a cross section perpendicular to the axial direction (see FIG. 1*a*), the channel 3 forms end portions 7 on the opposite side of an intermediate portion 8. The end portions 7 extend towards an opening into the channel 3. In the embodiment shown in FIGS. 1 and 1*a*, the channel 3 forms a quadrangular shape with a front wall 9, a rear wall 10 and two sidewalls 11 in a cross section perpendicular to the axial direction. Thus, the opening in the channel 3 is formed in the front wall 9. In this embodiment, the front wall 9 comprises the end portions 7 and the rear wall 10 comprises the intermediate portion 8. Furthermore, this embodiment comprises a front wall 9 and a rear wall 10, which are essentially parallel, and sidewalls 11 also being essentially parallel. Due to the quadrangular shape of the channel of this embodiment, the front and rear walls 9, 10 are essentially perpendicular to the sidewalls 11.

Figure 2:
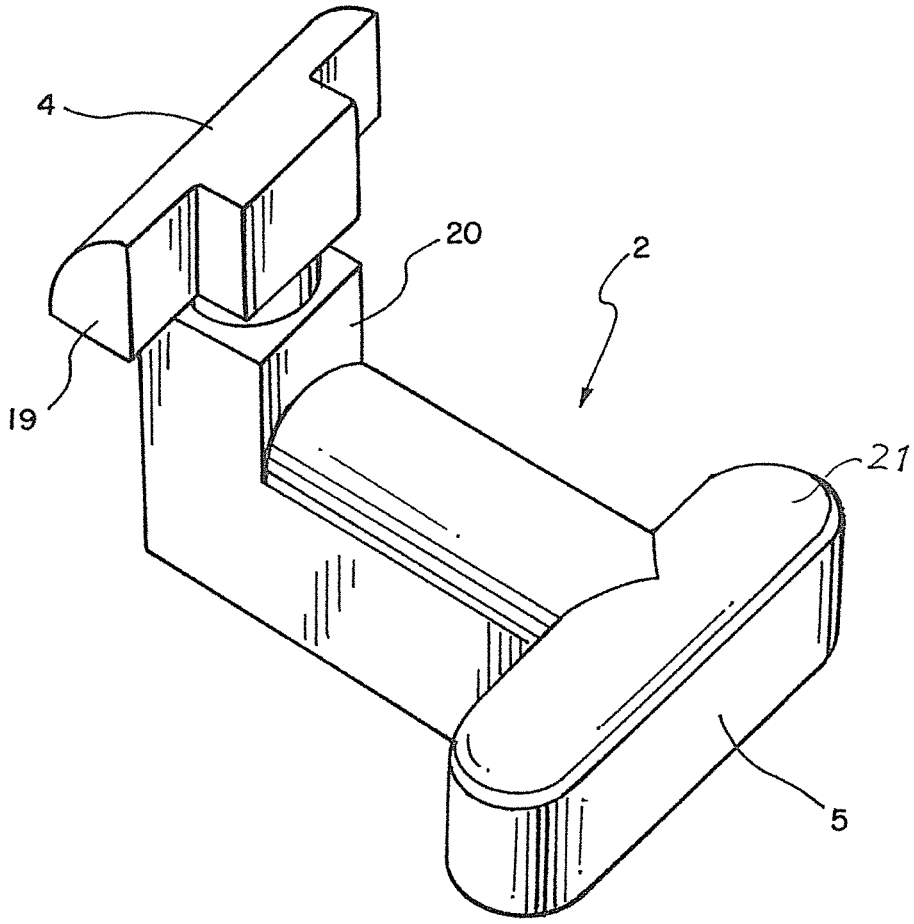
FIGS. 2-3 show a first embodiment of a fitting element.
Figure 3:
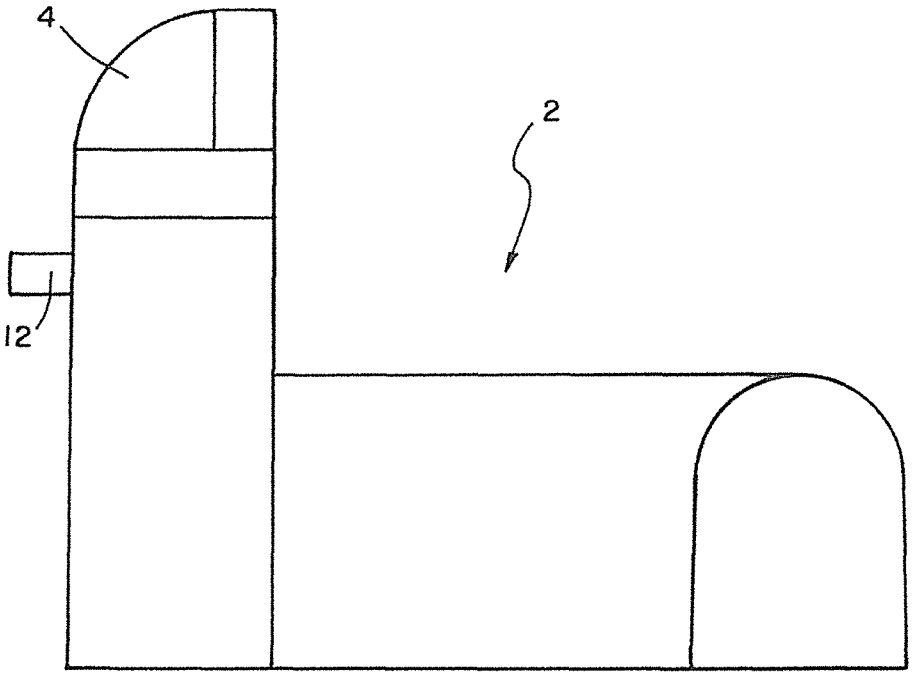

FIG. 3 shows the fitting element 2 shown in FIG. 2 in a different view.

Figure 4:
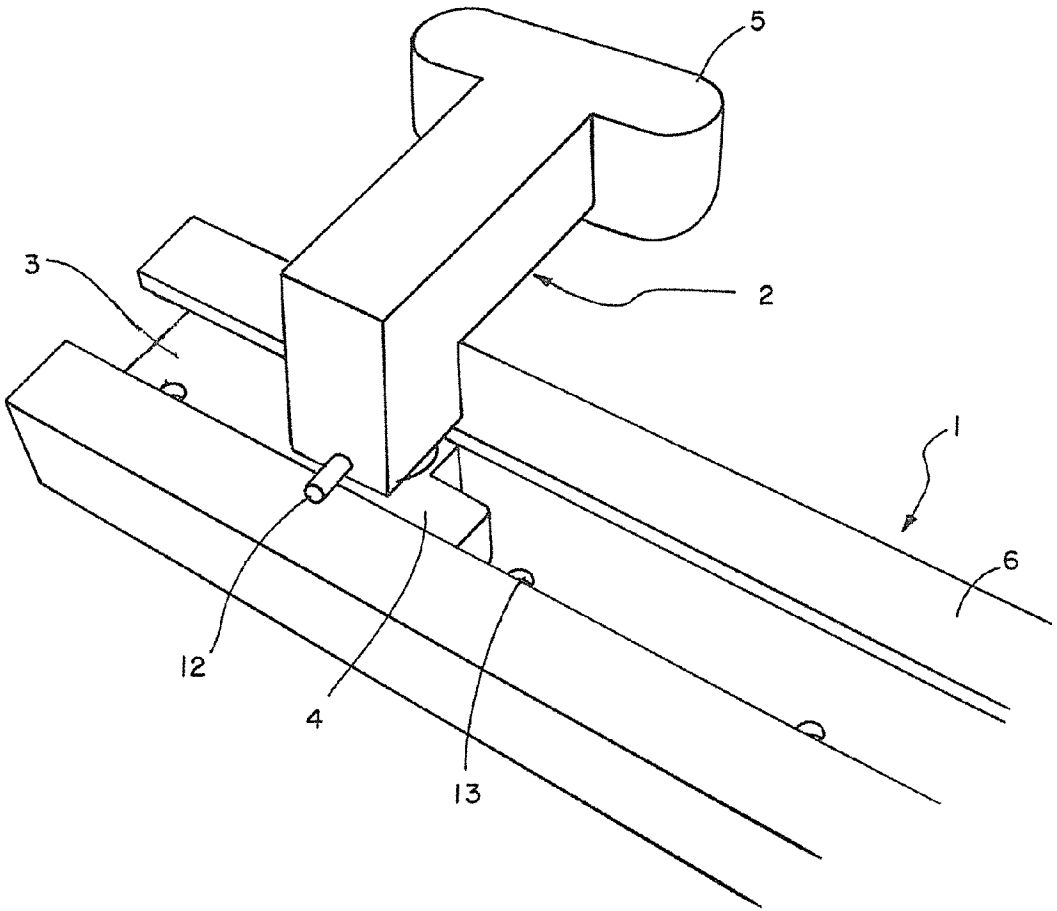
FIGS. 4-6 show the fitting element of FIGS. 2 and 3 and an embodiment of an elongated track element.
Figure 5:
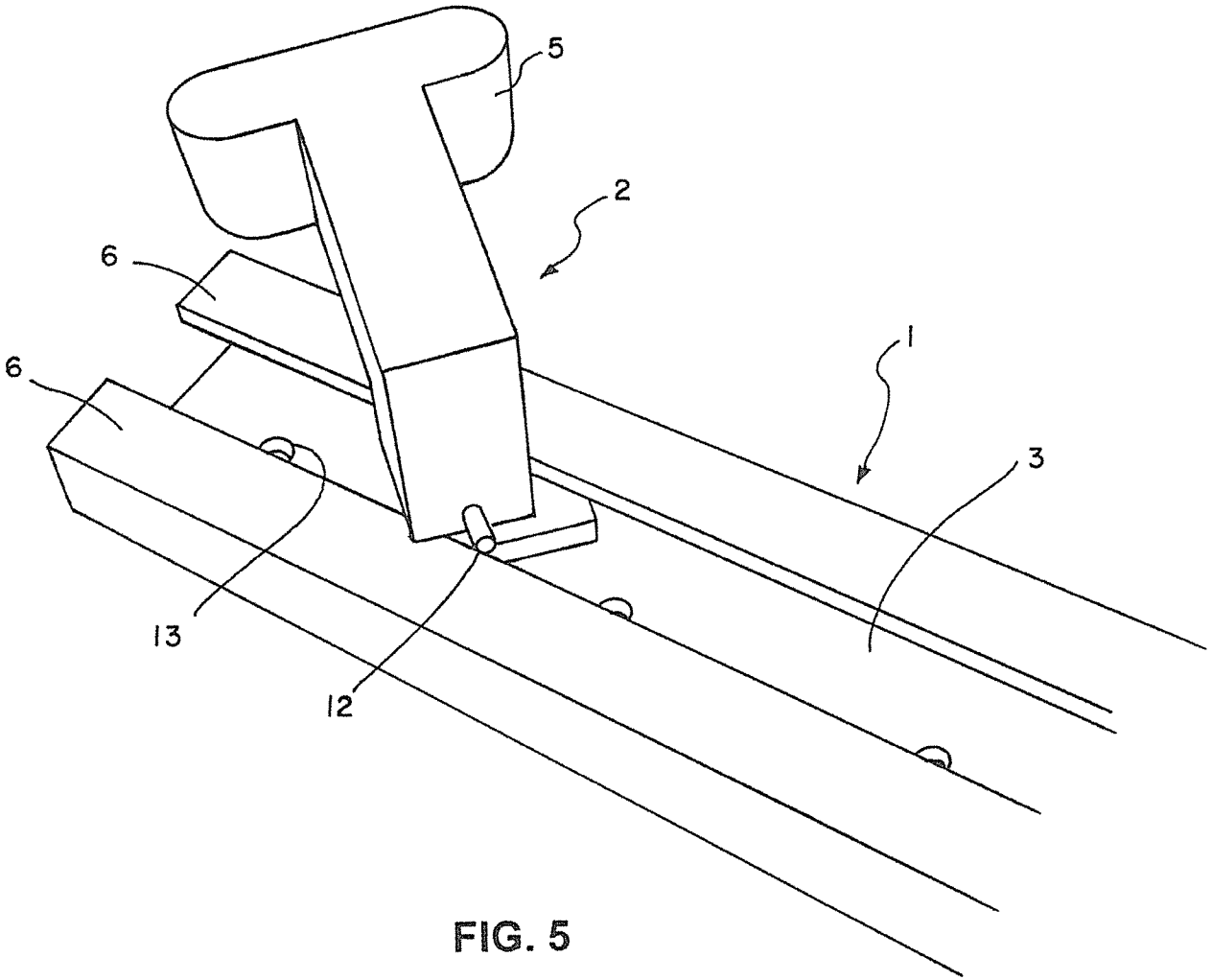
Figure 6:
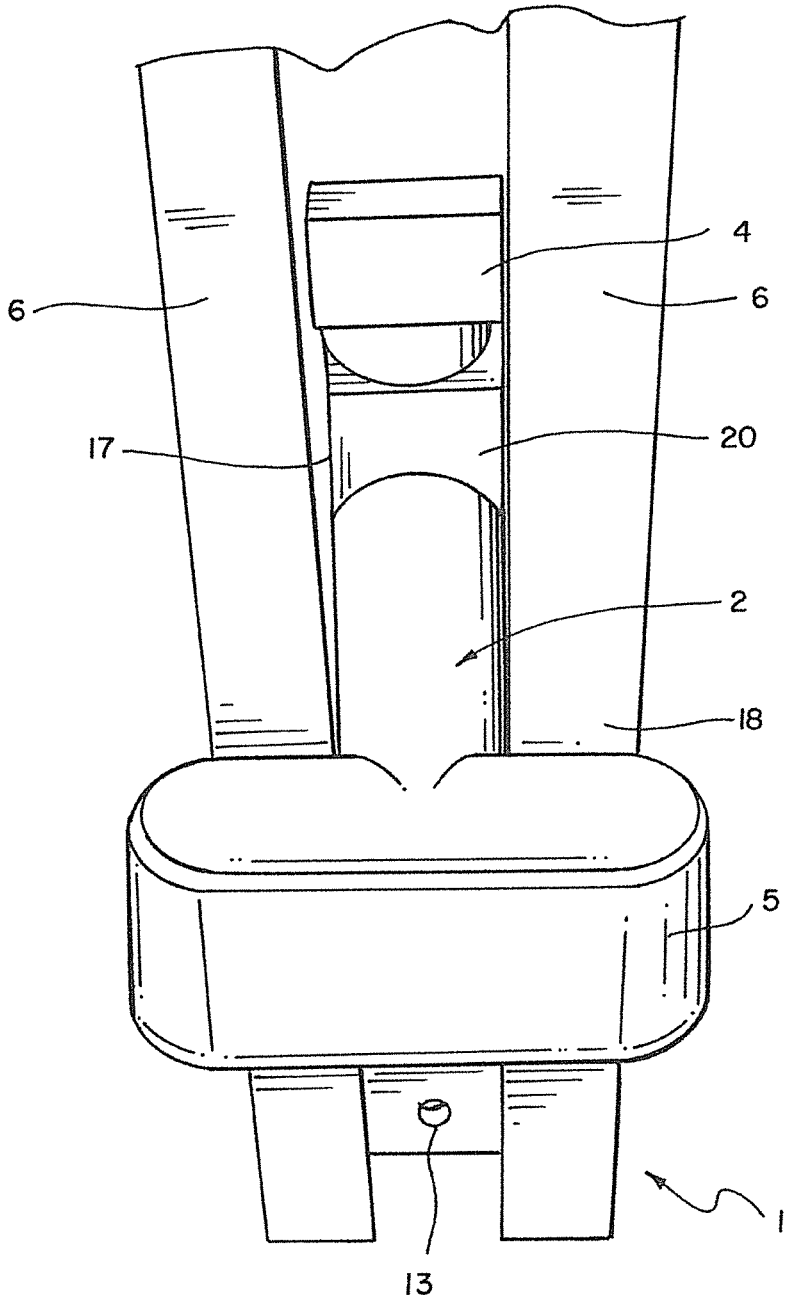

FIGS. 4-6 show the elongated track element 1 and the fitting element 2 cooperating to define different orientations, In the open mutual orientation, the first locking portion 4 is allowed passage into and out of the channel 3, which orientation can be seen in FIG. 4.

FIG. 5 shows how the fitting element 2 is turned, while the first locking porting 4 is in the channel 3. When the fitting element 2 is turned 90 degrees around an axis perpendicular to the axial direction, the fitting element 2 and the elongated track element 1 define a closed mutual orientation (not shown), where the first locking portion 4 is movable in the axial direction within the channel 3.

FIG. 6 shows the fixed mutual orientation, in which orientation the first locking portion 4 is locked immovably relative to the elongated track element 1. When locking the first locking portion 4 immovably, the fitting element 2 is tilted 90 degrees along the axial direction and possibly lifted upwards or pushed downwards to ensure cooperation between locking features 12, 13.

In order to lock the fitting element 2 immovably relative to the elongated track element 1, the fitting element 2 and elongated track element 1 comprise locking features 12, 13 cooperating to prevent movement of the fitting element 2 in the axial direction when the elongated track element 1 and the filling element 2 cooperates to define the fixed mutual orientation. These locking features 12, 13 provide a plurality of locking positions at the elongated track element 1 along the axial direction. As shown in FIGS. 3-5, the locking features of the fitting element 2 comprise protrusions 12 adapted to engage corresponding cavities 13 in the channel 3 in order to fixate the fitting element 2 in the elongated track element 1. The corresponding cavities 13 being formed in the rear wall 10 are shown in FIG. 1. The cavities 13 are positioned with a predetermined distance along the whole length of the elongated track element 1 in order to be able to lock the fitting element 2 at a plurality of locking positions, and in order to be able to attach a plurality of fitting elements 2 to the elongated track element 1.

As shown in FIG. 6, the fitting element 2 forms an essentially plane surface portion 17 when the first locking portion 4 is locked immovably relative to the elongated track element 1, which plane surface portion 17 Is in level with the upper surface 18 of the elongated track element 1. The first locking portion 4 is provided as a T-shaped portion with a transverse portion 19 extending perpendicularly to a main portion 20 (see FIG. 2). In this position, the main portion 20 is shaped so that it extends in the axial direction. The second locking portion 5 has a protrusion with a conically shaped upper surface 21, which protrusion extends perpendicular to the plane surface portion 17 of the fitting element 2.

As shown in FIGS. 2-6, this embodiment of the fitting element 2 comprises a second locking portion 5, which is formed to engage a depression or hole at the second furniture element, e.g. a shelf element or a bottom element. The second locking portion 5 comprises a protrusion with a conically shaped upper surface 21, whereby the distance between the first furniture element, e.g. a sidewall element of a cupboard, and the second furniture element, e.g. a shelf element, may be reduced when the second locking portion 5 engages the depression or hole of the second furniture element. The elongated track element 1 may be countersunk into the first furniture element in order to reduce the distance between the furniture elements even further.

Figure 7:
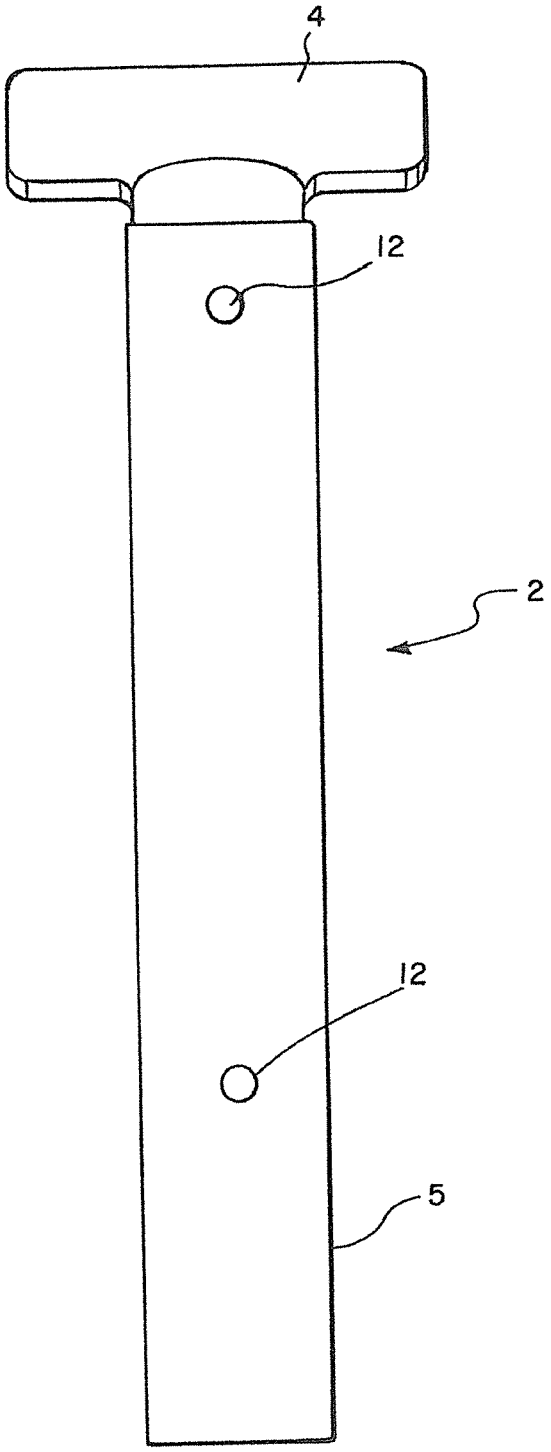
FIGS. 7-8 show a second embodiment of a fitting element.
Figure 8:
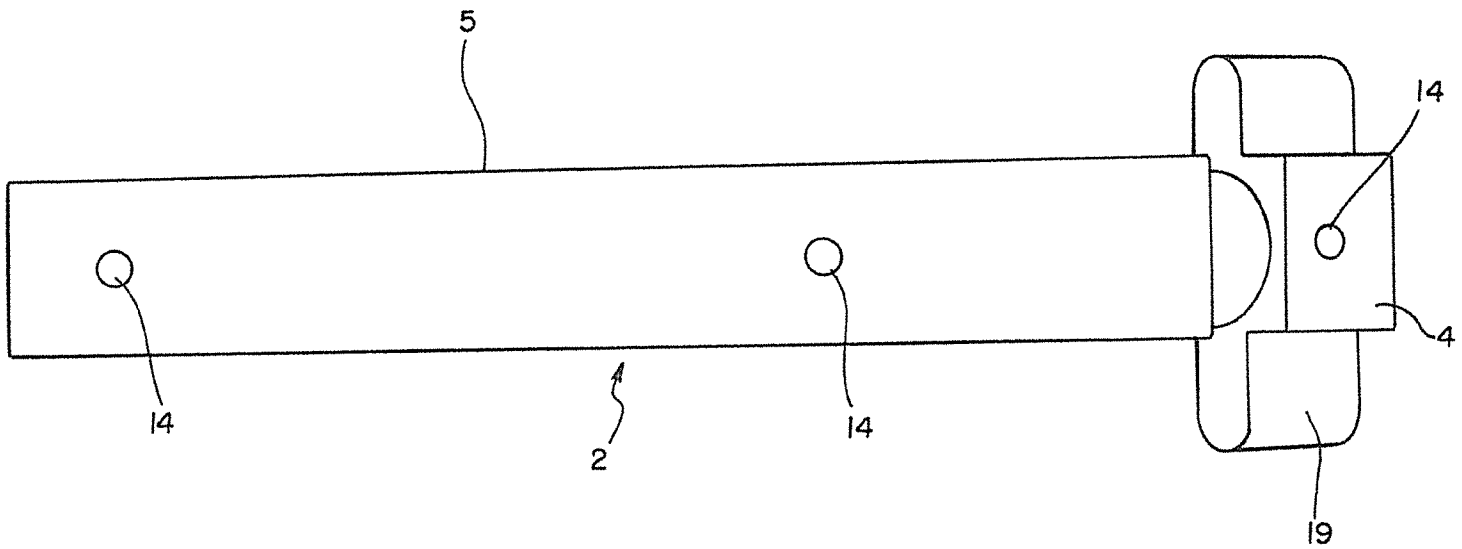
Figure 9:
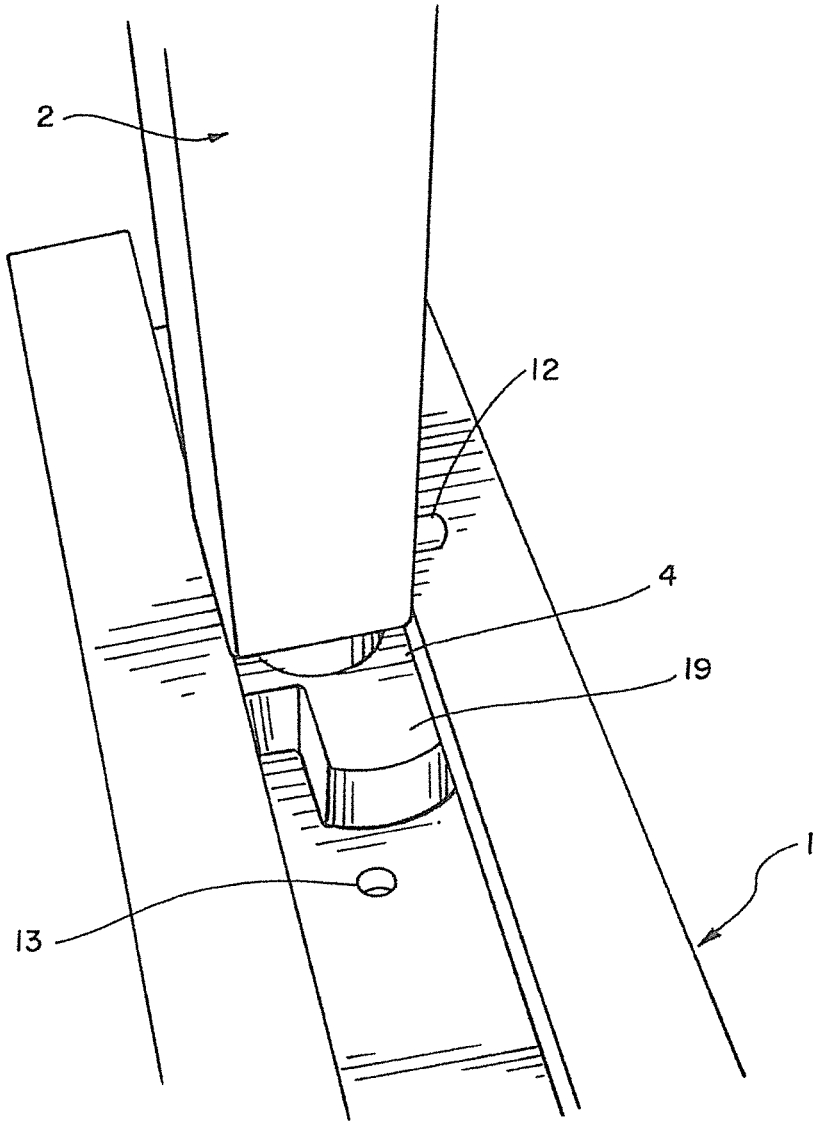
FIGS. 9-12 show the fitting element of FIGS. 7 and 8 and an embodiment of an elongated track element.

FIGS. 7-8 show a second embodiment of a fitting element 2 according to the invention. The second locking portion 5 of this embodiment is elongated and therefore not formed to engage a depression or hole of the second furniture element. Instead, the second locking portion 5 comprises hinge cavities 14 at the front side (see FIG. 8). These hinge cavities 14 may be use to attach a hinge to the fitting element 2 by screws which are screwed into the hinge cavities 14. The other part of the hinge may be attached to a second furniture element in the form of e.g. a door element, whereby this embodiment of a fitting element 2 together with an elongated track element 1 may be used to connect a first furniture element In the form of a sidewall element and a second furniture element In the form of a door element or drawer system etc.

At the backside (see FIG. 7), the fitting element 2 comprises locking features in the form of protrusions 12 adapted to engage corresponding cavities 13 at the elongated track element 1 (see FIG. 1). The first locking portion 4 of this embodiment of a fitting element 2 is identical to the first locking portion 4 of the first embodiment of a fitting element 1 as shown in FIGS. 2-3.

Figure 10:
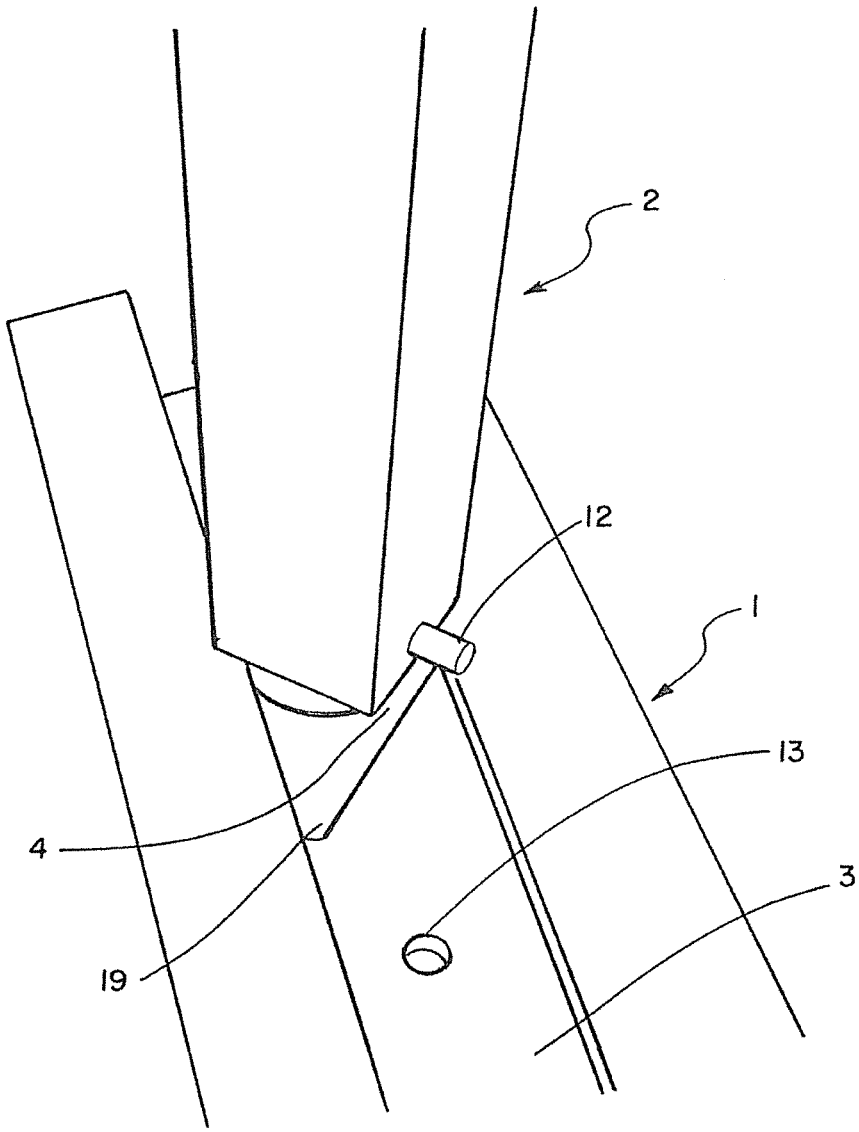
Figure 11:
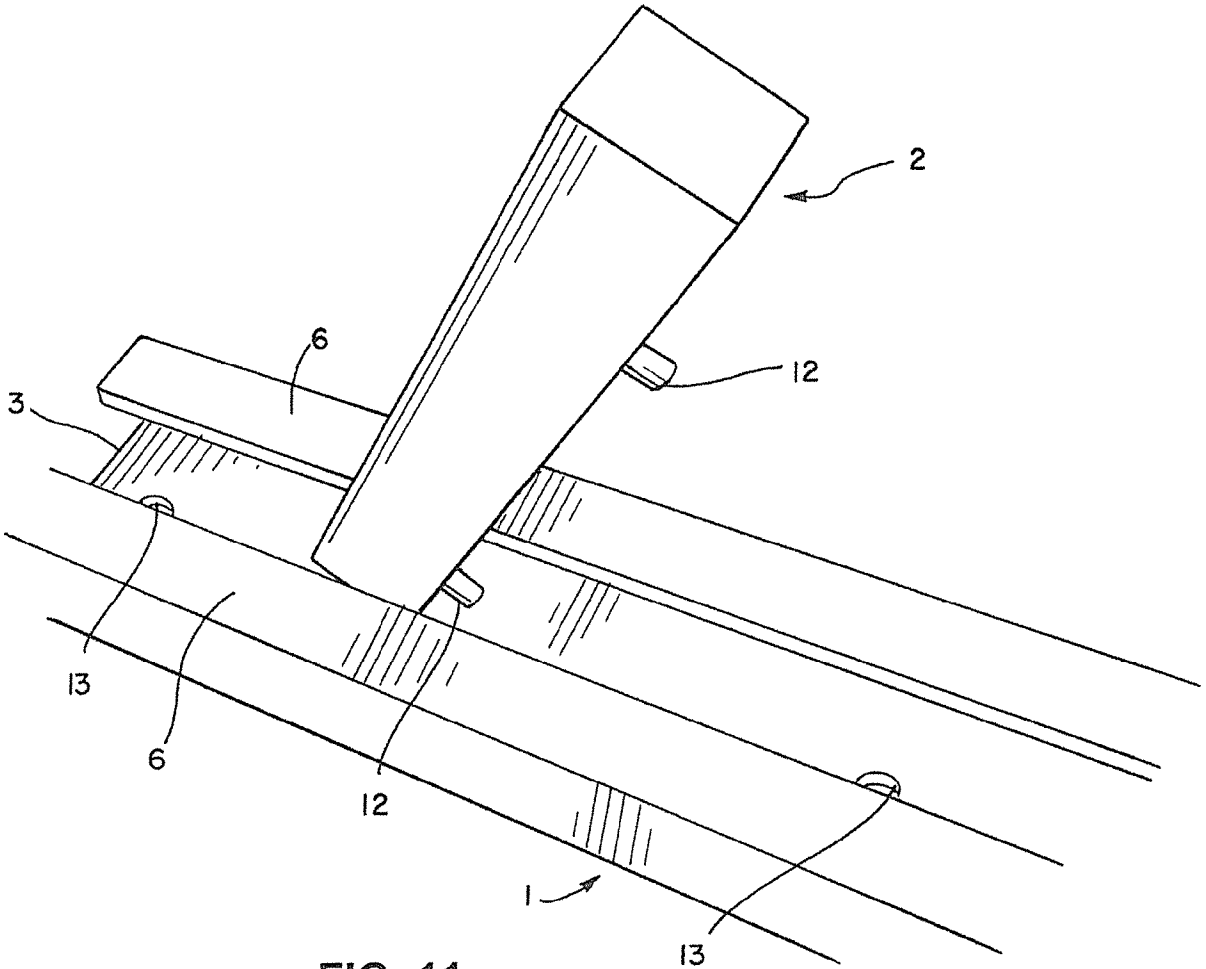
Figure 12:
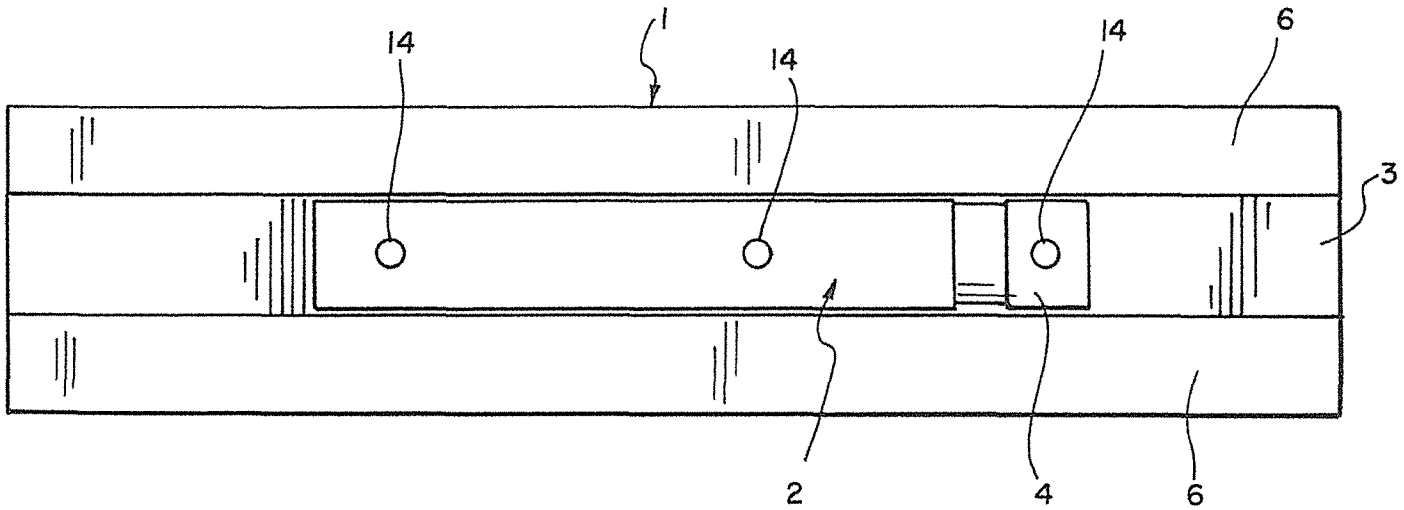

FIGS. 9-12 show that the second embodiment of the fitting element 2 and the elongated track element 1 also cooperate to define different orientations. In the open mutual orientation, the first locking portion 4 is allowed passage into and out of the channel 3, which orientation can be seen in FIG. 9. FIG. 10 shows how the fitting element 2 is turned, the first locking porting 4 being in the channel 3. When the fitting element 2 is turned 90 degrees around an axis perpendicular to the axial direction, the first locking portion 4 is in the closed mutual orientation (not shown), where the first locking portion 4 is moveable in the axial direction within the channel 3. FIG. 11 shows how the fitting element 2 is tilted 90 degrees along the axial direction In order to lock the first locking portion 4 immovably relative to the elongated track element 1. The fitting element 2 may possibly be lifted upwards or pushed downwards in connection with the tilting thereof in order to ensure cooperation between the locking features 12, 13. FIG. 12 shows the fixed mutual orientation, in which the first locking portion 4 is locked immovably.

As shown in the above-described FIGS. 1-12; the two different embodiments of the fitting element 2 are adapted to for the same type of elongated track element 1, whereby the assembly system Is flexible and easy to use. The elongated track element 1 may be countersunk in a sidewall element or a back wall element of cupboard (a first furniture element) and depending on the type of second furniture element (a shelf element, a top element, a bottom element, a door element, etc,); the applicable embodiment of a fitting element 2 may be chosen.

Figure 13:
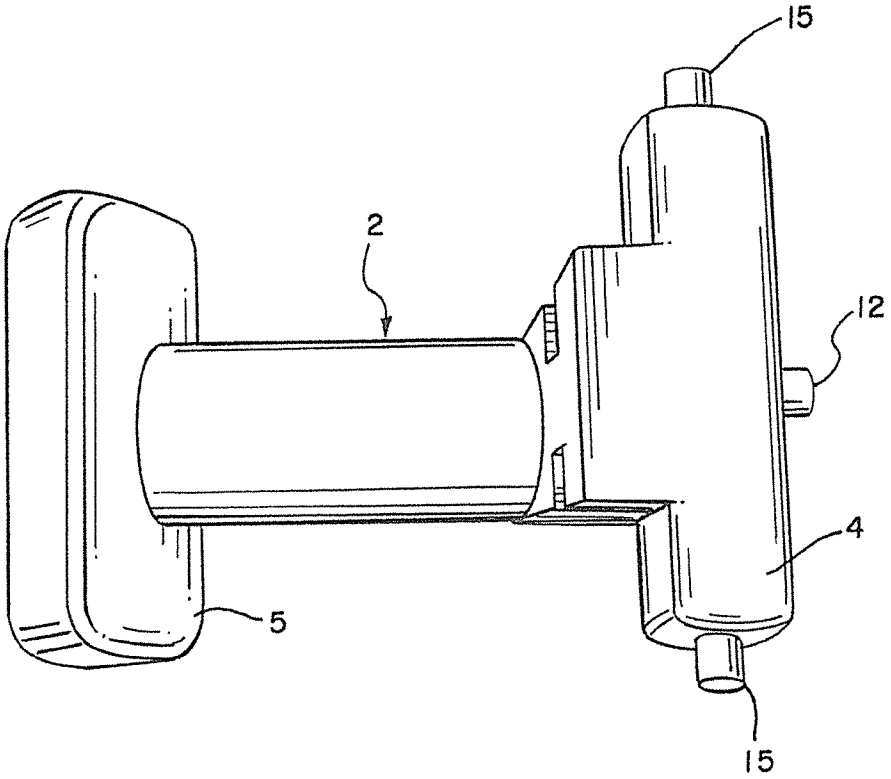
FIG. 13 shows a third embodiment of a fitting element.
Figure 14:
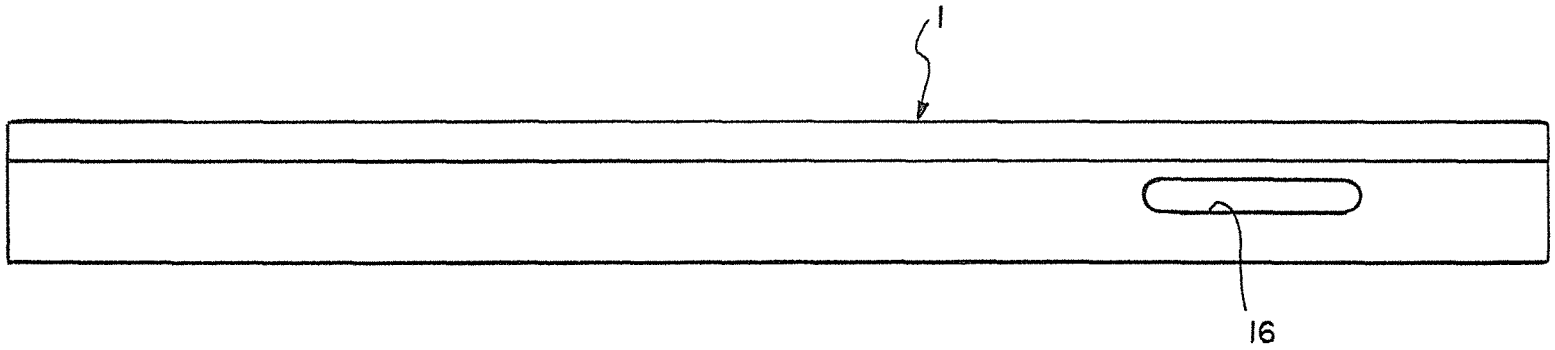
FIGS. 14-15 show a second embodiment of an elongated track element.
Figure 15:
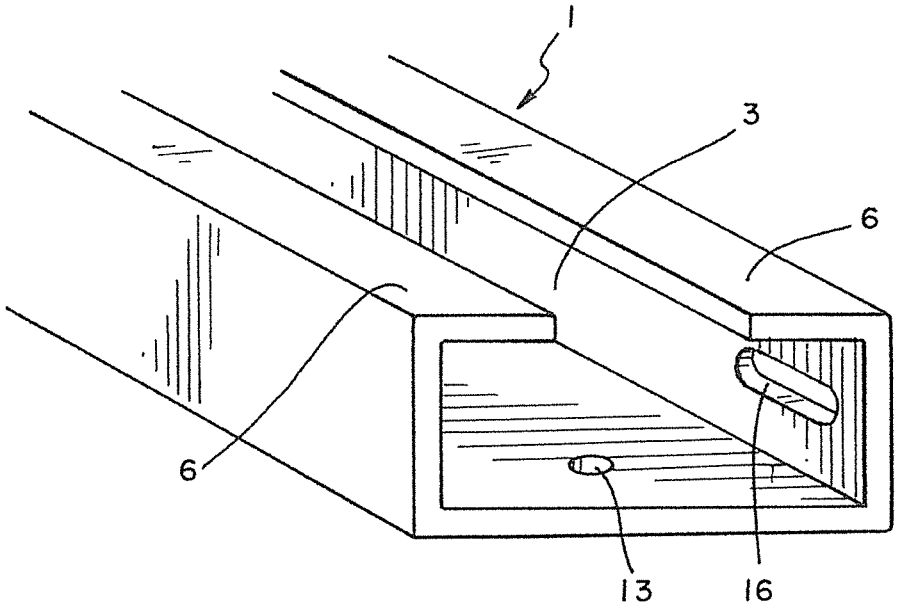

FIG. 13 shows a third embodiment of a fitting element 2 according to the present invention. In this embodiment; the first locking portion 4 comprises additional locking features in the form of sideways extending protrusions 15. These sideways extending protrusions 15 are adapted to engage corresponding side cavities 16 in the sidewall 11 of the channel 3, see FIGS. 14-15. The side cavities 16 are elongated cavities in order to be able to turn the fitting element 2 90 degrees around an axis perpendicular to the axial direction, and thereby be able to rotate it from the open mutual orientation to the dosed mutual orientation.

Figure 16:
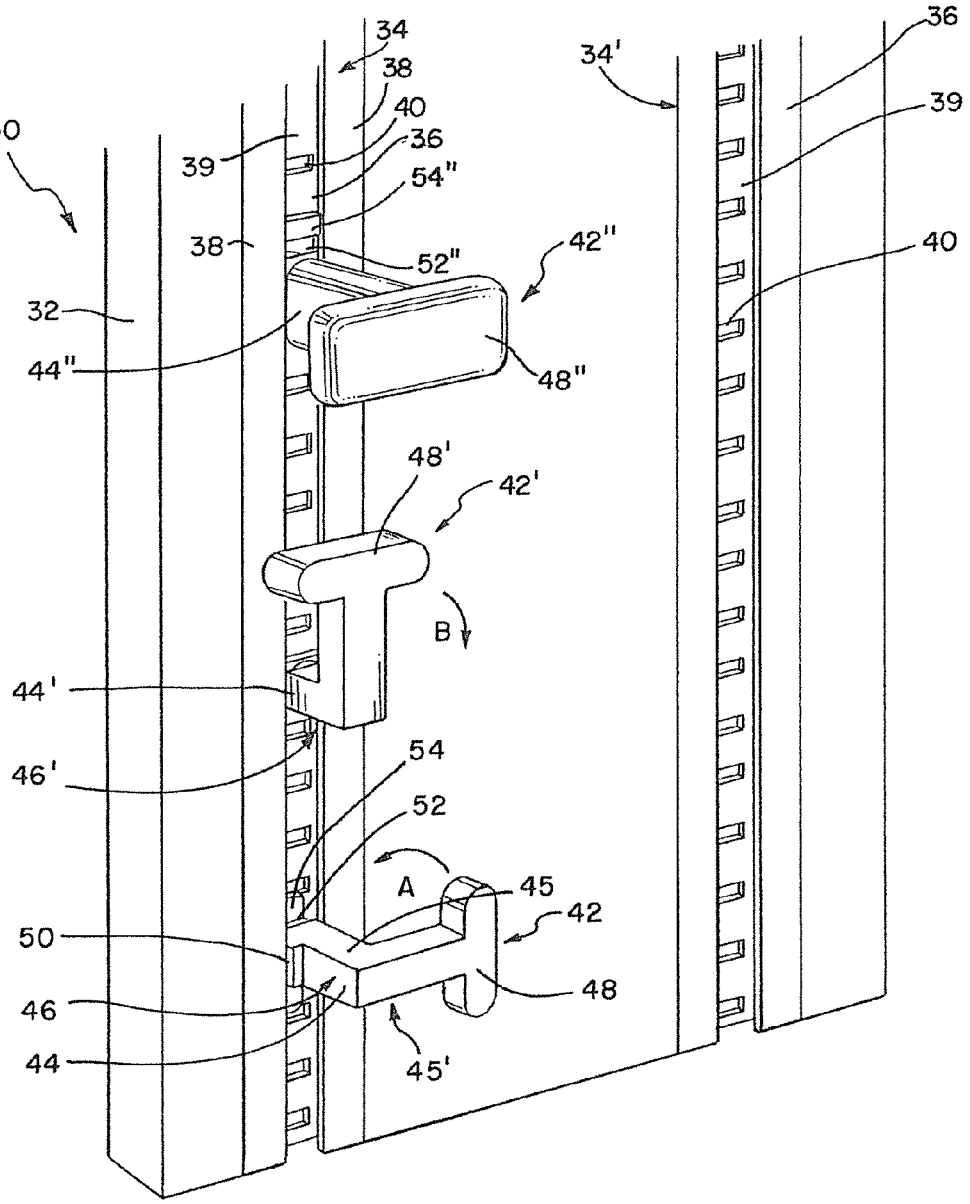
FIG. 16 shows a piece of furniture including a system according to the present invention.

FIG. 16 shows a perspective view of a piece of furniture 30. The piece of furniture may constitute a book case, a cabinet, a cupboard or the like. The piece of furniture 30 comprises a plane wall element 32 extending in a longitudinal direction, which typically is being a vertical direction. The plane wall element 32 may be positioned on a solid surface (not shown) or alternatively be mounted on a wall (not shown). The plane wall element 32 comprises a pair of countersunk track elements 34 and 34$^{I}$, which extend parallel in the vertical direction of the plane wall element 32. The track element 34 comprises a bottom wall 36, which is recessed in relation to the surface of the plane wall element 32. The track element 34 further comprises two opposite front flanges 38, which are extending outwardly in relation to the bottom wall 36 and subsequently extend inwardly towards each other. The front flanges 38 each thus define an L shape and defining between them a channel 39 having a specific width between them constituting and opening for accessing the bottom wall 36. The bottom wall 36 further comprises a multitude of substantially rectangular indentations 40, which are spaced apart equidistantly a specific distance. The indentations 40 may optionally be replaced by apertures. The track element should be made of a rigid material, typically a metal material and preferably either steel or aluminium.

The piece of furniture 30 further comprises fitting elements 42. The fitting elements 42 are preferably made of the same material as the track elements, e.g. aluminium or steel. The fitting elements 42 comprise a main portion 44 constituting a rectangular body defining a pair of opposite parallel side surfaces 45 and 45$^{I}$ and a plane rear surface 46. The rear surface 46 is plane and oriented perpendicularly in relation to the side surfaces 45 45$^{I}$ which as well are both plane. Both side surfaces 45 and 45$^{I}$ are further connected to an extension part 48, which is positioned opposite the rear surface 46. The side surfaces 45 and 45$^{I}$ define a distance between them, which is equal or slightly smaller than the width of the channel 39 between the front flanges 38. The rear surface 46 further comprises an arresting pin 50 protruding outwardly in relation to the rear surface. The arresting pin has a substantially rectangular shape equal to or slightly smaller than the indentation 40 of the bottom wall 36 of the track element 34 for being able to fit within the indentation 40.

The fitting element 42 further comprises a junction part 52 extending from the main portion 44 in a direction to the rear surface 44 and a side surface 45. The junction part 52 is rounded and having a width equal to or slightly smaller than the width of the channel 39 of the track element 34. The junction part 52 is further connected to a transversal bar 54 having a length perpendicular to the side surface 45 exceeding the specific width of the channel 39 between the front flanges 38, however not exceeding the width of the bottom wall 36. The thickness of the transversal bar 54 should be smaller than the specific width of the channel 39. The transversal bar 54 may be optionally rounded.

The fitting element 42 is mounted and arrested to the track element 34 by following a three-step operation. The three step operation is described in FIG. 16 by a first fitting element 42 defining a first position, the fitting element 42$^{I}$ defining a second position and the fitting element 42$^{II}$ defining a third position of the three step operation. The first step of the three-step operation, which is shown in relation to the first position of the fitting element 42, involves positioning the fitting element 42 in front of the channel 39 of the track element 34 so that the transversal bar 54 is oriented having its length parallel with the vertical direction of the channel 39 of the track element 34. The transversal bar 54 is then introduced into the channel 39 and accommodated in the channel, the junction part 52 is positioned in the channel 39 between the front flanges 38, and the remaining portion of the fitting element including the main portion 44 is positioned in front of the front flanges 38.

In the second step, the fitting element 42 is rotated by 90 degrees around an axis defined by the junction part 52 in a direction as indicated in the figure by arrow A, i.e. the extension part 48 is being rotated upwardly by 90 degrees while maintaining the transversal bar 54 within the channel for achieving the second position as indicated by the fitting elements 48$^{I}$. In the second position the rear surface 46$^{I}$ is oriented in a downwardly direction. The fitting element 42$^{I}$ is then subsequently rotated around an axis defined by the transversal bar 54 in a direction as indicated by the arrow B such that the rear surface 46 is juxtaposed the bottom wall 36 of the track element 34. The transversal bar 54 remains within the channel 39 for achieving a third position indicated by the fitting element 42$^{II}$.

In a third step, the fitting element 42$^{II}$ is shifted vertically along the direction of the track element 34 by the user. When the user has found a suitable position among the available positions defined by the multitude of indentations 40 of the fitting element 42$^{II}$, the arresting pin 50 is caused to enter a single indentation 40 for the fitting element 42 and be arrested at the user-selected position. When the arresting pin 50 has been arrested within the single indentations 40, the fitting element 42 is locked in place and may withstand a downwardly oriented force which is applied to the extension part 48. In the present embodiment, the cooperation between the arresting pin 50 and the indentation 40 will hold a downwardly force applied to the extension part 48. The arresting pin 50 is kept within the indentation 40 by the cooperation between the transversal bar 54 and the front flanges 38 counteracting the rotation momentum induced by a downwardly directed force on the extension part 48 and preventing the arresting pin 50 from slipping out of the indentation 40.

A single fitting element 42 may be used for accommodating e.g. a hinge for a door or a gate etc. Two opposing fitting elements mounted on two opposing track elements 34 of two opposing wall elements 32 may be used to hold a horizontal wall element (not shown), which may constitute e.g. a shelf.

The fitting element 42 may be removed by performing the three step operation in reverse order, i.e. first rotating the fitting element 42 upwardly around the transversal bar, subsequently sideward around the junction part 52 and finally removing the fitting element 42 from the channel 39.

In the below description of variants of elongated track elements and fitting elements and further fittings and connectors, components or elements serving the same purpose as components or elements, respectively, described above with reference to the drawings' FIGS. 1-16 however differing in the geometrical configuration or shape, the fittings, connectors etc. are designated the same reference numeral as used above, however, added a marking for indicating the geometrical difference.

Figure 17C:
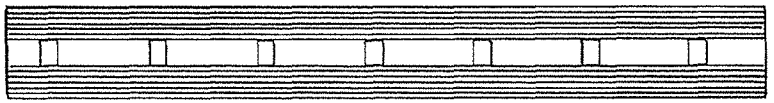
FIGS. 17C-17H show elevational views of the elongated track element shown in FIGS. 17A and 17B, FIGS. 18A and 18B show perspective views of a further embodiment of a fitting element to be used in combination with the elongated track element shown in FIGS. 17A-17H, FIGS. 18C-18H show elevational views of the fitting element shown in FIGS. 18A and 18B, FIGS. 19A and 19B show perspective views of a shelf brick element to be built into a furniture element and to be used in combination with the fitting element shown in FIGS. 18A-18H, FIGS. 19C-19F show elevational views of the shelf brick element shown in FIGS. 19A-19B, FIGS. 20A and 20B show perspective views of a connector element to be used in combination with the elongated track element shown in FIGS. 17A-17H, FIGS. 20C-20H show elevational views of the connector element shown in FIGS. 20A and 20B, FIGS. 21A and 21B show perspective views of an alternative embodiment of the connector element shown in FIGS. 20A-20H, FIGS. 21C-21H show elevational views of the connector element shown in FIGS. 21A and 21B, FIGS. 22A and 22B show perspective views of an alternative fitting element to be used for supporting a tabletop and intended to be used in combination with the elongated track element shown in FIGS. 17A-17H, FIGS. 22C-22H show elevational views of the alternative fitting element shown in FIGS. 22A and 22B, FIGS. 23A and 23B show perspective views of a connector element constituting a blocker and intended to be used in combination with the elongated track element shown in FIGS. 17A-17H, FIGS. 23C-23H show elevational views of the connector element shown in FIGS. 23A and 23B, FIGS. 24A and 24B show perspective views of a further connector element including two closing magnets and intended to be used in combination with the elongated track element shown in FIGS. 17A-17H, FIGS. 24C-24H show elevational views of the connector element shown in FIGS. 24A and 24B, FIGS. 25A and 25B show perspective views of a further connector element to be used in combination with the elongated track element shown in FIGS. 17A-17H, FIGS. 25C-25H show elevational views of the connector element shown in FIGS. 25A and 25B, FIGS. 26A and 26B show perspective views of a further connector element for connection to a side panel or blend panel and intended to be used in combination with the elongated track element shown in FIGS. 17A-17H or alternatively the shelf brick element shown in FIGS. 19A-19F, FIGS. 26C-26H show elevational views of the connector element shown in FIGS. 26A and 26B, FIGS. 27A and 27B show perspective views of a further built-in connector for use in combination with the connector elements shown in FIGS. 25A-25H, and FIGS. 27C-27H show elevational views of the connector shown in FIGS. 27A and 27B.
Figure 17D:
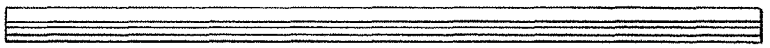
Figure 17E:
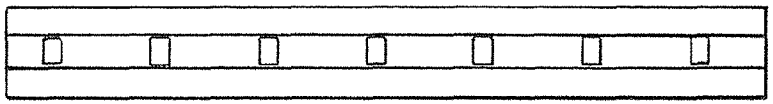
Figure 17F:
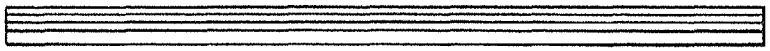
Figure 17H:
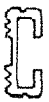
Figure 17G:
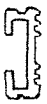
Figure 17B:
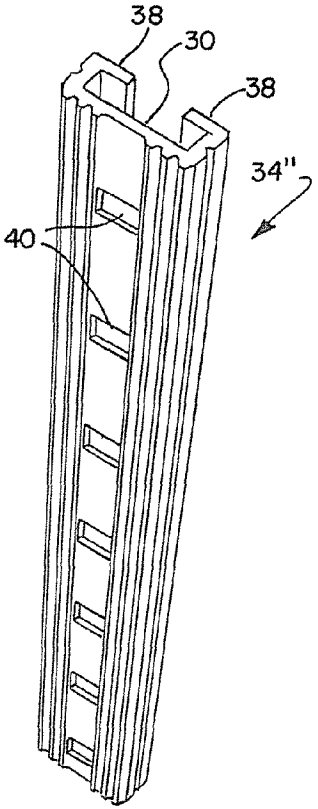
FIGS. 17A and 17B show perspective views of a further embodiment of an elongated track element.
Figure 17A:
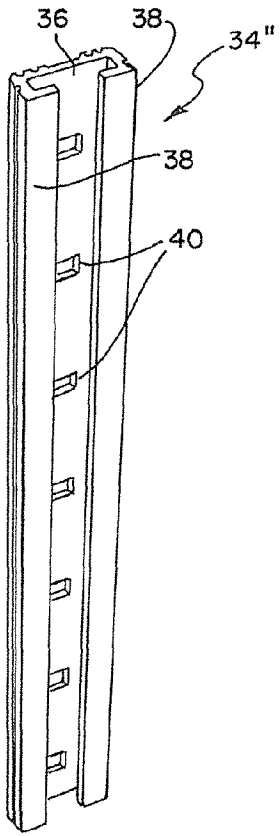

In FIGS. 17A and 17B, a further embodiment of the elongated track elements described above is shown designated the reference numeral $\mathbf{34}^{II}$. The elongated track element $\mathbf{34}^{II}$ shown in FIGS. 17A and 17B basically serves the same function as described above with reference to FIG. 16 and further includes as evident from FIG. 17B rear side corrugations for allowing the elongated track element to be fixated in a countersunk recess of a wall not shown in FIGS. 17A and 17B. The elongated track element $\mathbf{34}^{II}$ shown in FIGS. 17A and 17B further comprises the features described above with reference to FIG. 16, such as the bottom wall 36 and the flanges 38 and the indentations 40. No further description of these features or elements are presented here as reference is made to the above description referring to FIG. 16. In FIGS. 17C-17H the elongated track element $\mathbf{34}^{II}$ is shown in elevational rear view, elevational side view, elevational front view, elevational side view, elevational end view and elevational end view, respectively.

In FIG. 18, the fitting element 42 described above with reference to FIG. 16 is shown in greater detail and in FIGS. 18C-18H, the fitting element 42 is shown in top elevational view, side elevational view, bottom elevational view, side elevational view, end elevational view and front elevational view, respectively. The element is not to be described in greater detail here as reference is made to the above detailed description of the configuration and function of the fitting element referring to FIG. 16.

Figure 19A:
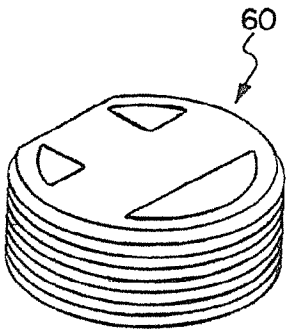
Figure 19B:
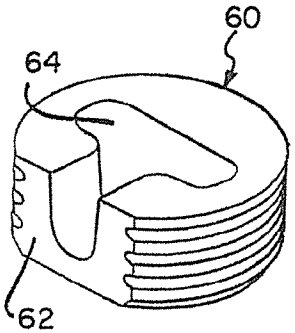
Figure 19C:
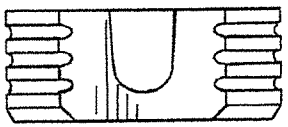
Figure 19D:
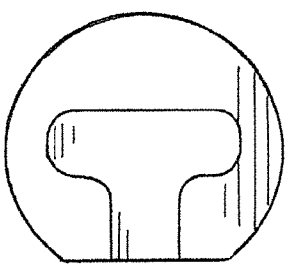
Figure 19E:
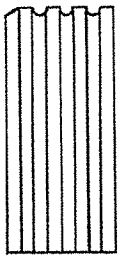
Figure 19F:
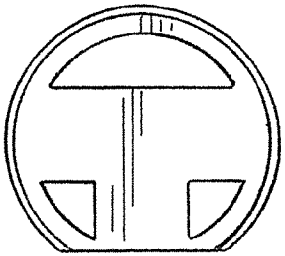

In FIGS. 19A and 19B, a shelf brick is shown which shelf may be used as an alternative to the elongated track element $\mathbf{34}^{II}$ shown in FIG. 17A-17H, as the brick element is fitted into a circular recess of a plane wall element such as the plane wall element 32 shown in FIG. 16. The shelf brick element shown in FIGS. 19A and 19B is designated the reference numeral 60 and constitutes a basically circular cylindrical body having a facial cut-away front wall 62 and defines a bottom side shown in FIG. 19A and a top side shown in FIG. 19B. In the top side a substantially T-shaped recess 64 is provided having a configuration corresponding to the freely extending part 48 of the fitting element 42 shown in FIGS. 18A-18H and further shown and described with reference to FIG. 16. FIGS. 19C-19F show a front elevational view, top elevational view, side elevational view and a bottom elevational view, respectively, of the shelf brick element 60.

Figure 20F:
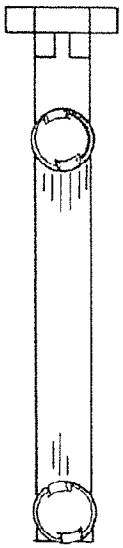
Figure 20E:
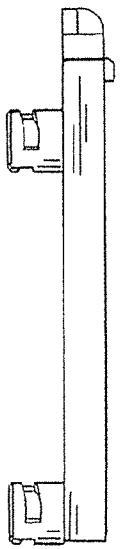
Figure 20D:
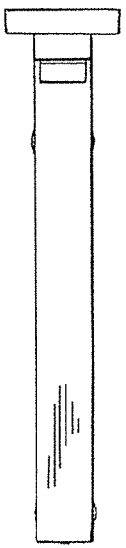
Figure 20C:
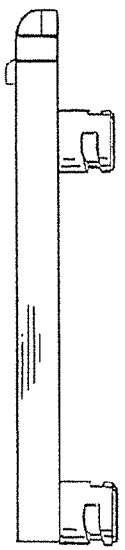
Figure 20B:
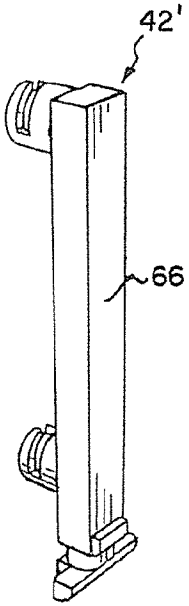
Figure 20A:
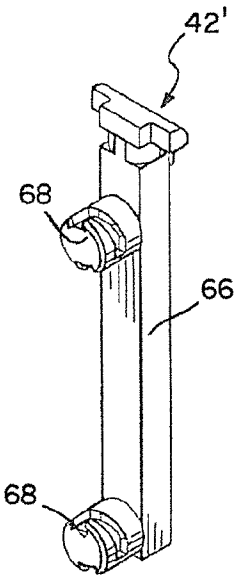
Figure 20H:
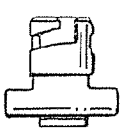
Figure 20G:
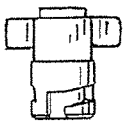

In FIGS. 20A and 20B, an alternative connector element is shown designated the reference numeral $\mathbf{42}^{I}$. The connector element $\mathbf{42}^{I}$ shown in FIGS. 20A and 20B constitutes an alternative to the fitting element 42 shown in FIGS. 16 and 18A-18F as the connector element is provided with an extension 66 as compared to the fitting element 42 which extension is provided with outwards protruding connectors 68 for the mounting of hinge or other component to be fixated relative to the piece of furniture in which the connector element $\mathbf{42}^{I}$ is fixated similar to the fixation described above with reference to FIG. 16 of the fitting element 42.

In FIGS. 20C-20H, the connector element $\mathbf{42}^{I}$ is shown in side elevational view, rear elevational view, side elevational view, front elevational view, bottom elevational view and top elevational view, respectively.

Figure 21F:
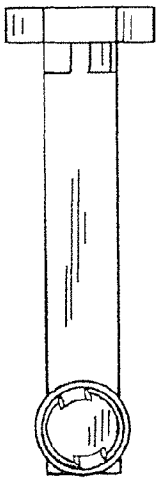
Figure 21E:
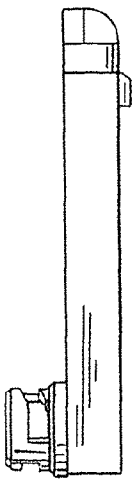
Figure 21D:
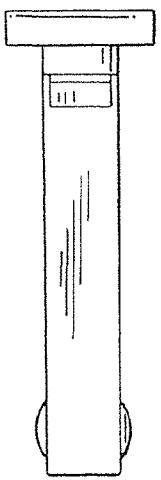
Figure 21C:
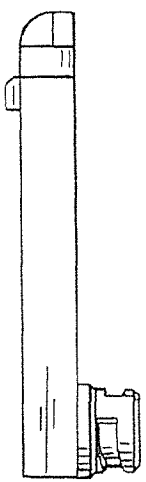
Figure 21B:
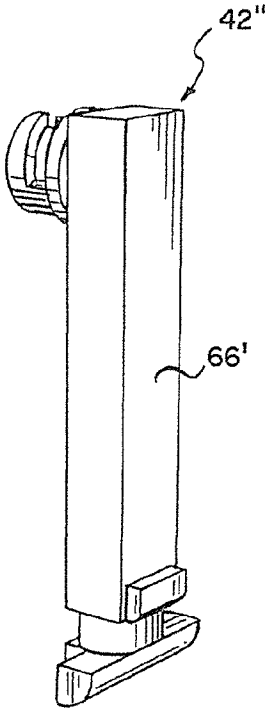
Figure 21A:
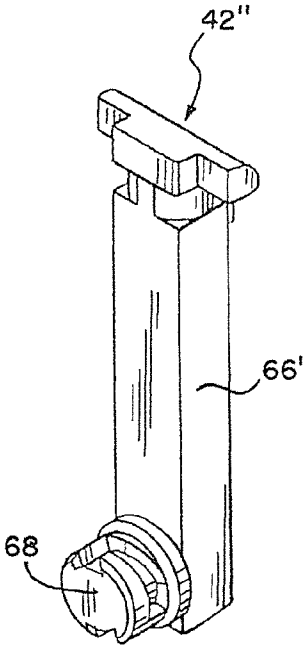
Figure 21G:
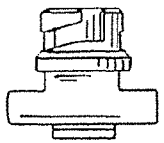
Figure 21H:
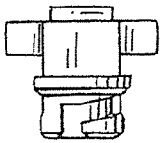

In FIGS. 21A and 21B, an alternative connector element $\mathbf{42}^{II}$ is shown, which element constitutes a variant of the connector element $\mathbf{42}^{I}$ described above with reference to FIGS. 20A-20H as the connector element $\mathbf{42}^{II}$ shown in FIGS. 21A and 21B is provided with a single outwards protruding connectors 68.

Similar to the views FIGS. 20C-20H, FIGS. 21C-21H illustrate the alternative connector element $\mathbf{42}^{II}$ shown in FIGS. 21A and 21B in side elevational view, rear elevational view, side elevational view, front elevational view, bottom elevational view and top elevational view, respectively.

In FIGS. 22A and 22B a further variant of the fitting element 42 described above with reference to FIGS. 16 and 18A-18H is shown which differs from the above-described fixation element 42 in that the element $\mathbf{42}^{III}$ shown in FIGS. 22A and 22B is provided with a sidewise eyelet extension 70 substituting the transversal extension part 48 of the fixation element 42 described above. The eyelet extension 70 may be used for fixating a screw, nail or similar element to a supporting horizontal surface which is fixated relative to a side panel by means of the connector element $\mathbf{42}^{III}$. In FIGS. 22C-22H, the connector element $\mathbf{42}^{III}$ is shown in side elevational view, front elevational view, side elevational view, rear elevational view, top elevational view and bottom elevational view, respectively.

In FIGS. 23A and 23B, a further alternative connector element $\mathbf{42}^{IV}$ is shown constituting a variant of the above-described connector elements $\mathbf{42}^{I}$ and $\mathbf{42}^{II}$ shown in FIGS. 20A-20H and 21A-21H, respectively, as the connector element $\mathbf{42}^{IV}$ shown in FIGS. 23A and 23B is provided with an extension $\mathbf{66}^{II}$ similar to the above-described extensions 66 and $\mathbf{66}^{I}$ of the connector elements $\mathbf{42}^{I}$ and $\mathbf{42}^{II}$, respectively, which extension $\mathbf{66}^{II}$ is provided with curved end face 69 serving as supporting face or a rest. In FIGS. 23C-23H, the connector element $\mathbf{42}^{IV}$ is shown in side elevational view, front elevational view, side elevational view, rear elevational view, bottom elevational view and top elevational view, respectively.

Figures 24A, 24B, 24C, 24D, 24E, 24F, 24G, 24H:
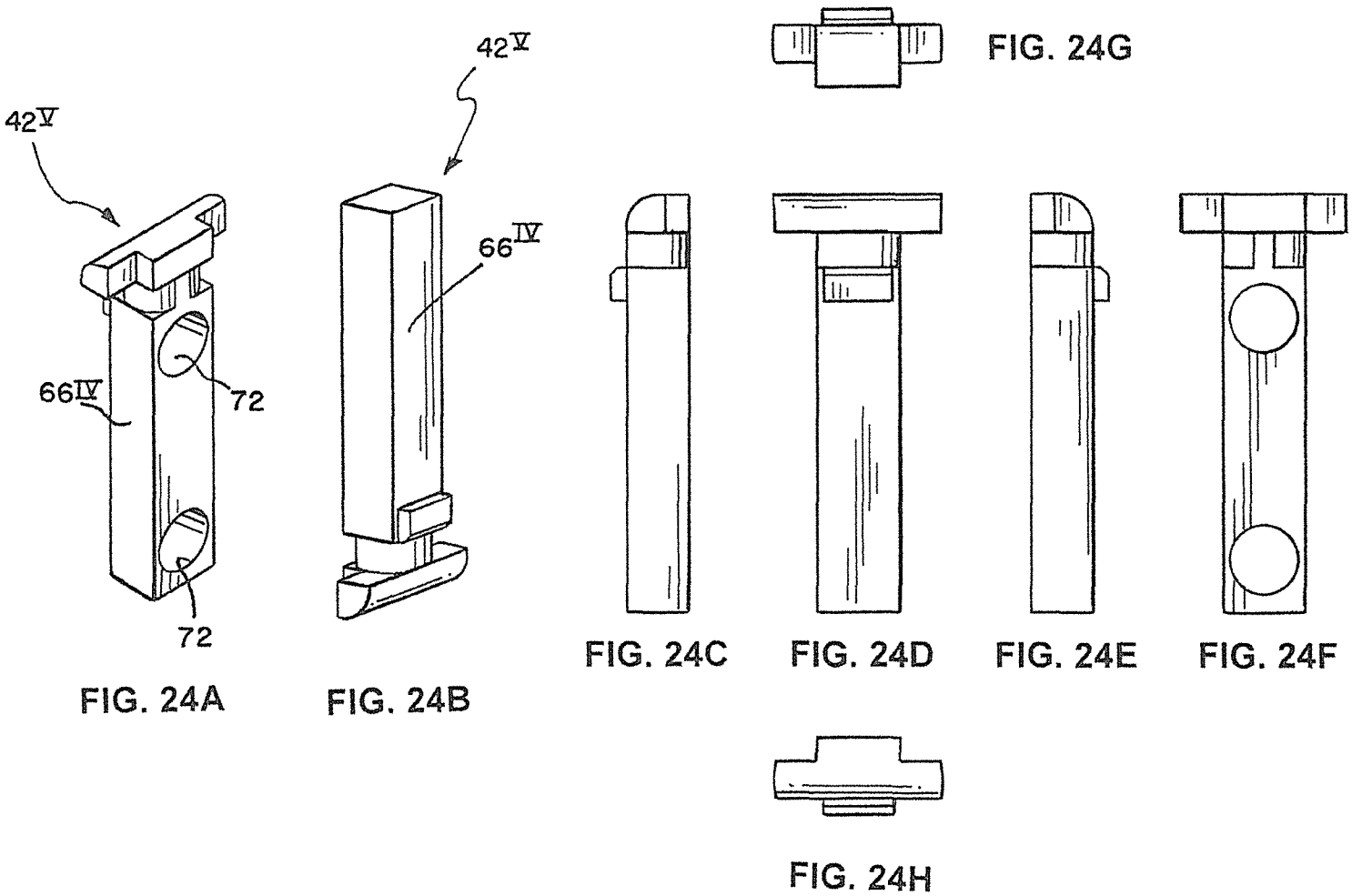

In FIGS. 24A and 24B, a further connector element $\mathbf{42}^{V}$ is shown differing from the above-described connector elements $\mathbf{42}^{I}$ and $\mathbf{42}^{II}$ shown in FIGS. 20A-20H and FIGS. 21A-21H, respectively, in that the connectors 68 are substituted by a pair of magnets 42 received within the recesses of the extension $\mathbf{66}^{IV}$ of the connector element $\mathbf{42}^{V}$. In FIGS. 24C-24H, the connector element $\mathbf{42}^{V}$ shown in FIGS. 24A and 24B is shown in side elevational view, rear elevational view, side elevational view, front elevational view, bottom elevational view and top elevational view, respectively.

Figure 25B:
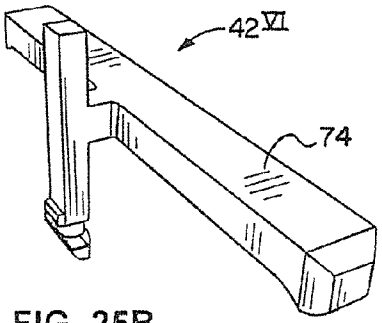
Figure 25F:
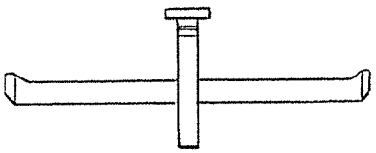
Figure 25E:
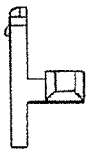
Figure 25A:
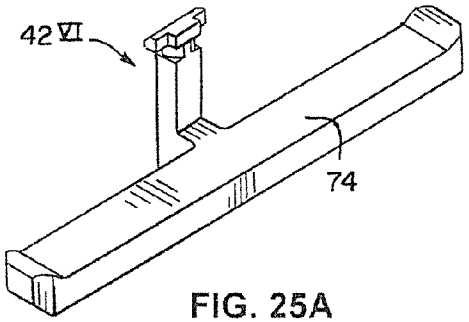
Figure 25G:
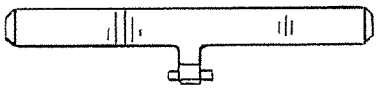
Figure 25D:
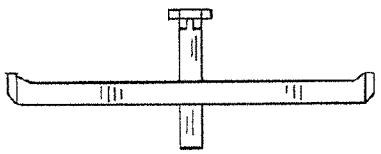
Figure 25C:
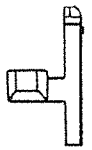
Figure 25H:
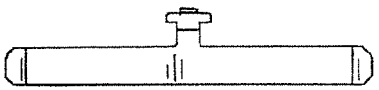

In FIGS. 25A and 25B, a further connector element $\mathbf{42}^{VI}$ is shown differing from the above-described connector element $\mathbf{42}^{I}$-$\mathbf{42}^{V}$ described above with reference to FIGS. 18-24 in that the element is provided with a major transversal bar 74 serving for the support of a plate which may be supported on the top surface of the bar 74 or alternatively fixated at the ends of the transversal bar 74. In FIGS. 25C-25H, the connector element $\mathbf{42}^{VI}$ is shown in side elevational view, bottom elevational view, front elevational view, top elevational view, side elevational view and rear elevational view, respectively.

In FIGS. 26A and 26B a further connector element $\mathbf{42}^{VII}$ is shown having an extension $\mathbf{66}^{V}$ similar to the extensions 66-$\mathbf{66}^{V}$ of the connector embodiments shown in FIGS. 20, 21

23 and 24. At the bottom end of the extension 66V, a clips is provided designated the reference numeral 76 servicing for receiving a side or rear panel of a piece of furniture. In FIGS. 26C-26H, the connector $42^{VII}$ shown in FIGS. 26A and 26B is shown in rear elevational view, side elevational view, front elevational view, side elevational view, bottom elevational view and top elevational view, respectively.

Figure 27A:
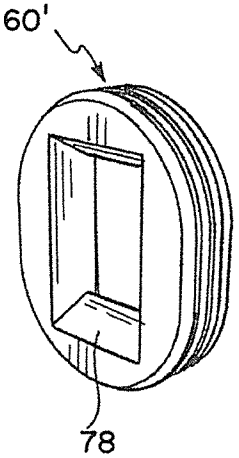
Figure 27B:
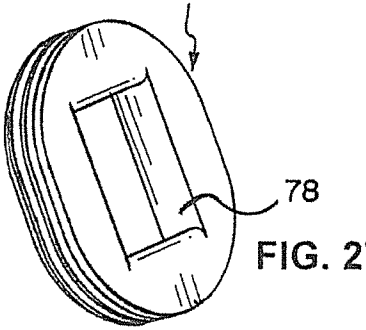
Figure 27C:
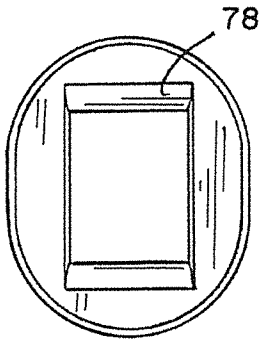
Figure 27D:
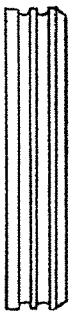
Figure 27E:
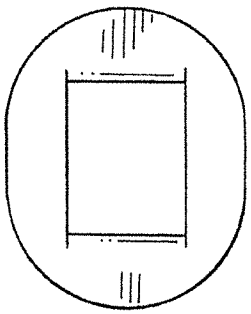
Figure 27F:
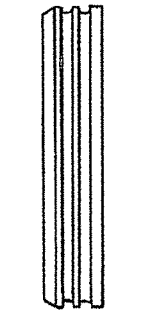
Figure 27G:
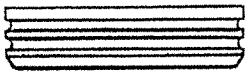
Figure 27H:
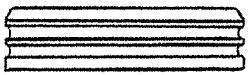

In FIGS. 27A and C, a further fitting element $60^{I}$ is shown similar to the shelf brick element 60 described above with reference to FIGS. 19A-19F. The fitting $60^{I}$ serves to corporate with the above connector element $42^{VI}$ for fixating the fitting $60^{I}$ at the outmost ends of the transversal bar 74 of the connector element $42^{VI}$. The fitting $60^{I}$ is basically an oval, cylindrical body having a central inwardly tapering rectangular aperture. The aperture serves to allow a panel in which the fitting $60^{I}$ is mounted to be cooperating with and fixated relative to the end part of the transversal bar 74 of the connector element $42^{VI}$. In FIGS. 27C-27H, the fitting $60^{I}$ is shown in front elevational view, side elevational view, rear elevational view, side elevational view, elevational view and bottom elevational view, respectively.

Although the present invention has above been described with reference to specific preferred embodiment, it is evident to person skilled in the art, that numerous modifications may be incorporated in the above-described embodiment and further, alternative embodiments may be deduced in accordance with the teachings of the present invention and the teachings is defined in the appending patent claims.

POINTS CHARACTERISING THE INVENTION

1. An assembly system for furniture, the system comprising:
   an elongated track element which is attachable to a first furniture element and which defines a channel extending in an axial direction and
   a fitting element with a first locking portion,
the elongated track element and fitting element cooperating to define:
   an open mutual orientation, wherein the first locking portion is allowed passage into and out of the channel,
   a closed mutual orientation, wherein the first locking portion is movable in the axial direction within the channel, and
   a fixed mutual orientation, wherein the first locking portion is locked immovably relative to the elongated track element.
2. An assembly system according to point 1, wherein the elongated track element comprises a flange portion defining an opening into the channel and allowing passage of the first locking portion into the channel in the open mutual orientation and which prevents movement of the first locking portion out of the channel in the closed mutual orientation.
3, An assembly system according to points 1-2, wherein the fitting element further comprises a second locking portion adapted to retain a second furniture element.
4. An assembly system according to any of the preceding points, wherein the fitting element and elongated track element comprise locking features cooperating to prevent movement of the fitting element in the axial direction when the fitting element and the elongated track element define the fixed mutual orientation.
5. An assembly system according to point 4, wherein the locking features provide a plurality of locking positions at the elongated track element along the axial direction at which locking positions movement of the fitting element Is prevented.
6. An assembly system according to point 4 or 5, wherein the locking features of the fitting element comprise protrusions adapted to engage corresponding cavities in the channel to fixate the fitting element in the elongated track element.
7. An assembly system according to any of points 4-6, wherein the locking features comprise an indented surface of one of the fitting element and the elongated track element arranged to engage a projection or Indentation in the other one of the fitting element and elongated track element.
8. An assembly system according to any of the preceding points, wherein the channel in a cross section perpendicular to the axial direction forms end portions on opposite side of an intermediate portion, the end portions extending towards an opening into the channel.
9. An assembly system according to point 8, wherein the channel in a cross section perpendicular to the axial direction forms an quadrangular shape with a front wall, a rear wall and two sidewalls, the opening being formed in the front wall.
10. An assembly system according to point 9, wherein the front wall and rear wall are essentially parallel.
11. An assembly system according to point 9, wherein the sidewalls are essentially parallel.
12. An assembly system according to point 9, wherein the front and rear walls are perpendicular to the sidewalls.
13. An assembly system according to any of points 6-12, wherein the cavities are formed in the rear wall.
14. An assembly system according to any of points 3-13, wherein the second locking portion is formed to engage a depression of the second furniture element.
15. An assembly system according to point 14, wherein the fitting element is shaped to reduce the distance between the first and second furniture elements when the second locking portion engages the depression.
16. An assembly system according to any of point 1-13, wherein the second locking portion is connected to a hinge to support a door element.
17. A piece of furniture with at least a first furniture element and a second furniture element, the furniture elements being connected by an assembly system, said assembly system comprising;
   an elongated track element attached to the first furniture element, which elongated track element defines a channel extending In an axial direction, and
   a fitting element with a first locking portion,
the elongated track element and fitting element cooperating to define:
   an open mutual orientation, wherein the first locking portion is allowed passage into and out of the channel,
   a closed mutual orientation, wherein the first locking portion is movable In the axial direction within the channel, and
   a fixed mutual orientation, wherein the first locking portion is locked immovably relative to the elongated track element.
18. An assembly for making furniture, the assembly comprising:
   at least one furniture element comprising an elongated track element which defines a channel extending in an axial direction,
   at least one fitting element with a first locking portion, and
   at least one additional furniture element to be joined to the other furniture element via the fitting element,
the elongated track element and fitting element cooperating to define:

an open mutual orientation, wherein the first locking portion is allowed passage into and out of the channel, a dosed mutual orientation, wherein the first locking portion is movable in the axial direction within the channel, and a fixed mutual orientation, wherein the first locking portion is locked immovably relative to the elongated track element.

19. A method of assembling a piece of furniture from at least two furniture elements, one of which being provided with an elongated track element which defines a channel extending in the axial direction and the other furniture element being provided with a feature which cooperate with a fitting element with a first locking portion, the elongated track element and fitting element cooperating to define:

an open mutual orientation, wherein the first locking portion Is allowed passage into and out of the channel, a closed mutual orientation, wherein the first locking portion Is movable In the axial direction within the channel, and a fixed mutual orientation, wherein the first locking portion is locked immovably relative to the elongated track element, the method comprising the steps of:

inserting the first locking portion into the channel of the elongated track element, reorienting the fitting element in the channel, and attaching the other furniture element to the fitting element.

The invention claimed is:

1. A system for assembling a piece of furniture having a first wall element and a second element, the system comprising:

an elongated track element defining a longitudinal direction, the elongated track element including a recessed bottom wall and opposed front flanges defining therebetween a channel of a specific width, the recessed bottom wall being spaced at a specific distance behind the opposed front flanges and having a plurality of spaced-apart indentations or apertures, the elongated track element being attachable to the first wall element of the piece of furniture; and a fitting element, comprising:

a main portion defining opposed parallel side surfaces spaced apart a distance equal to or slightly smaller than the specific width and defining a front surface and an opposite rear surface;

an arresting pin extending outwardly from the rear surface of the main portion of the fitting element, the arresting pin being configured to be received within any of the plurality of spaced-apart indentations or apertures; and a transversal bar having a length exceeding the specific width and a maximum thickness smaller than the specific width, the transversal bar extending parallel with the front and rear surfaces of the main portion of the fitting element;

wherein the fitting element is configured to be mounted in and arrested relative to the elongated track element when the transversal bar is positioned within the channel of the elongated track element perpendicular to the longitudinal direction of the elongated track element, with the rear surface of the main portion of the fitting element positioned adjacent the bottom wall of the elongated track element so that the arresting pin is received within a selectable one of the plurality indentations or apertures of the bottom wall of the elongated track element.

2. The system of claim 1, wherein the fitting element includes a rounded junction part interconnecting the transversal bar and the main portion.

3. The system of claim 1, wherein the transversal bar has a rear rounded surface.

4. The system of claim 1, wherein the indentations or apertures and the arresting pin having cooperating cross sectional configurations.

5. The system of claim 1, wherein the fitting element further comprises an extension extending from the front wall of the main portion and configured for supporting the second element of the piece of furniture.

6. The system of claim 5, wherein the extension defines a supporting surface having an orientation perpendicular to the opposed front flanges of the elongated track element when the fitting element is mounted in and arrested relative to the elongated track element.

7. The system of claim 1, wherein the fitting element further comprises an extension extending from the front wall of the main portion and configured for being received in a cooperating mechanical element on the second element of the piece of furniture.

8. A method for assembling a piece of furniture having a first wall element and a second element, the method comprising:

(a) providing an elongated track element defining a longitudinal direction, the elongated track element including a recessed bottom wall and opposed front flanges defining therebetween a channel of a specific width, the recessed bottom wall being spaced at a specific distance behind the opposed front flanges and having a plurality of spaced apart indentations or apertures, the elongated track element being attachable to the first plane wall element of the piece of furniture; and (b) providing a fitting element having (i) a main portion defining opposed parallel side surfaces spaced apart a distance equal to or slightly smaller than the specific width and defining a front surface and an opposite rear surface, (ii) an arresting pin extending outwardly from the rear surface of the main portion, and (iii) a transversal bar with a length exceeding the specific width and with a maximum thickness smaller than the specific width, the transversal bar extending parallel with the front and rear surfaces of the main portion of the fitting element;

(c) introducing the fitting element into the channel with the transversal bar orientated parallel with the longitudinal direction and with the front and rear surfaces of the main portion of the fitting element extending parallel with the opposed front flanges of the elongated track element;

(d) rotating the fitting element while maintaining the transversal bar within the channel of the elongated track element so as to position the transversal bar perpendicular to the longitudinal direction of the elongated track element, and positioning the rear surface of the main portion of the fitting element adjacent the bottom wall of the elongated track element for allowing the fitting element to be shifted along the longitudinal direction relative to the elongated track element; and (e) receiving the arresting pin within a selected one of the indentations or apertures of the bottom wall of the elongated track element so as to arrest the fitting element relative to the elongated track element.

9. The method of claim 8, wherein the fitting element includes a rounded junction part interconnecting the transversal bar and the main portion.

10. The method of claim 8, wherein the transversal bar has a rear rounded surface.

11. The method of claim 8, wherein the indentations or apertures and the arresting pin having cooperating cross sectional configurations.

12. The method of claim 8, wherein the fitting element further comprises an extension extending from the front wall of the main portion and configured for supporting the second element of the piece of furniture.

13. The method of claim 12, wherein the extension defines a supporting surface having an orientation perpendicular to the opposed front flanges of the elongated track element when the fitting element is mounted in and arrested relative to the elongated track element.

14. The method of claim 8, wherein the fitting element further comprises an extension extending from the front wall of the main portion and configured for being received in a cooperating mechanical element on the second element of the piece of furniture.

* * * * *